US005987929A

United States Patent [19]

Bostani

[11] Patent Number: 5,987,929

[45] Date of Patent: Nov. 23, 1999

[54] METHOD AND APPARATUS FOR FABRICATION OF COMPOSITE AND ARBITRARY THREE DIMENSIONAL OBJECTS

[76] Inventor: Arman Bostani, 10515 Tennessee Ave., Los Angeles, Calif. 90064

[21] Appl. No.: 09/063,140

[22] Filed: Apr. 20, 1998

[51] Int. Cl.[6] ..... D04B 35/00

[52] U.S. Cl. ..... 66/1 R; 66/62; 66/64; 66/125 R

[58] Field of Search ..... 364/470.12; 66/1 R, 66/7, 5, 6, 60 R, 62, 64, 82 R, 114, 231, 238, 125 R

[56] References Cited

U.S. PATENT DOCUMENTS

| | | | |
|---|---|---|---|
| 4,078,253 | 3/1978 | Kajiura et al. | 364/470.12 |
| 4,183,232 | 1/1980 | Banos et al. | 66/11 |
| 4,526,026 | 7/1985 | Krauland, Jr. | 66/1 R |
| 4,631,931 | 12/1986 | Banos | 66/83 |
| 4,779,429 | 10/1988 | Banos | 66/83 |

*Primary Examiner*—John J. Calvert
*Assistant Examiner*—Larry D. Worrell, Jr.
*Attorney, Agent, or Firm*—Farjami & Farjami

[57] ABSTRACT

The invention's object generator utilizes two frames, a y-frame that is atop an x-frame. The y-frame (or the x-frame) is divided into two halves. Each half of the y-frame (or the x-frame) contains a number of needles and latches. The needles in one half of the y-frame are opposed by the needles in the other half of the y-frame. Similarly, The needles in one half of the x-frame are opposed by the needles in the other half of the x-frame. The invention also includes a "head" which comprises a bobbin/tensioning mechanism along with other components. The object generator's head is movable to any location on a grid formed by the y-frame and x-frame. The head dispenses yarn under direction of a custom control software. A computer operating the invention's object generator has stored therein a three dimensional image of the object to be generated. The computer dissects the three dimensional image into two dimensional layer data. The computer and the custom control software feed the two dimensional layer data, layer by layer, to the invention's object generator. The needles of the invention's object generator perform various knitting actions on the yarn that is dispensed by the object generator's head. The needles generate two dimensional layers corresponding to the two dimensional layer data received from the computer. The two dimensional layers are built upon one another and gradually form a three dimensional object.

68 Claims, 15 Drawing Sheets

METHOD AND APPARATUS FOR FABRICATION OF COMPOSITE AND ARBITRARY THREE DIMENSIONAL OBJECTS

BACKGROUND OF THE INVENTION

1. Field of the Invention

The present invention relates to the field of computer driven apparatuses used for fabricating three dimensional objects.

2. Background Art

Various techniques for automatically producing patterns of knit or woven ware are presently known. By way of example, a computerized machine called "SYSTEMKNIT" has been developed by the Fibrous High Molecular Material Laboratory of the Ministry of International Trade and Industry of Japan. The pattern information for SYSTEMKNIT is derived from a design developed by an artist using a pattern analyzing device. To operate the SYSTEMKNIT machine, the patterns are scanned and fed to a knitting machine. However, the knitting machine can produce only two dimensional patterns with a negligible third dimension. In other words, the machine can only produce textile with very small thickness. The machine cannot produce truly three dimensional objects (either solid or hollow) of an arbitrary shape.

With recent technological advances, computerized representation of three dimensional models have become possible. Computers are now used to display a three dimensional model from various perspectives. Computers can also dissect a virtual three dimensional model (i.e., the three dimensional image of the three dimensional model) and display the various cross sections of the virtual model. Thus, creation, manipulation, and dissection of three-dimensional virtual models have become possible.

In great contrast, the present technology to translate such three dimensional images into physical three dimensional objects is very limited. Presently there exist computer driven devices that make solid prototypes using a single material. However, these computer driven devices are very limited in their application and versatility. For example, these devices can merely produce simple solid prototypes composed of a single material. The objects produced by these devices are simply prototypes and cannot be mass-manufactured. These computerized devices merely replace the manual process of making a prototype. Moreover, these devices lack versatility from other respects. For example, these computerized devices can only make an entirely solid prototype with no internal structures. In other words, these computerized devices cannot make hollow structures (such as a hollow cube, or an otherwise hollow cube that has internal pillars). Thus, these devices lack the critical element of arbitrariness. Moreover, the three dimensional solid prototypes made by these computerized devices comprise only a single material and not a composite of different materials. For example, the prototype cannot be made from a combination of metal, plastic, and fiber.

A more recent example of such computerized prototyping technology is a technology called "Rapid Prototyping" (or "RP"). Rapid Prototyping is a technology that produces prototypes from three dimensional computer-aided design ("CAD") model data. Rapid Prototyping systems join together liquid, powder, and sheet materials to form prototype parts. These systems fabricate objects using thin horizontal cross sections directly from a computer generated model. RP systems use only one material which can be plastic, wood, paper, or metal.

Some RP systems use laser to cut and shape soft material such as liquid polymers or waxes. Soft material such as liquid polymers are photo sensitive and after being shaped by the laser beam are hardened by a flood of light directed onto the surface of the material. Other RP systems use laser to cut sheet material such as paper. Thin layers of paper are cut into the shape of thin horizontal cross sections according to the CAD model data. The thin layers of paper are then pressed together and bonded by a heated roller. An RP part usually costs a few thousand dollars and takes a week or longer to produce and finish.

Some simpler, less expensive, RP systems that make more temporary prototypes are called 3D Printers. Some 3D Printers are machines that deposit layers of thermoplastic material using ink jet technology. Other 3D Printers create plastic models one droplet at a time using ink jet technology. While the life of an RP part is often days or weeks, the life of a 3D printed part may be only minutes or hours. The RP machines and 3D Printing machines suffer from similar disadvantages discussed above. Namely, these machines cannot create hollow three dimensional objects of arbitrary shapes. Moreover, these machines cannot produce objects that are made of composite material. Also, the primary material that these machines can use are soft, malleable, and/or easily cut which severely limits the practical use of such machines.

Conventional knitting machines offer some arbitrariness in the structure and configuration of the knitted object and are capable of knitting materials of different types. However, conventional knitting machines produce only textile which is practically two dimensional. Although, from a technical point of view, the textile has a small thickness (which makes up its third dimension), the textile is not truly three dimensional; it is merely technically three dimensional. In fact, the Textile Institute's Terms and Definitions Glossary defines the term "textile" as "any manufacture from fibers, filaments, or yarns characterized by flexibility, fineness and a high ratio of length to thickness." The differences between textile and a "real" three dimensional object are many. First, a real three dimensional object can have a thickness equal to, or even greater than, its length or width. Second, a real three dimensional object can be solid or hollow. Textile, although of very small thickness, is manifestly a solid object. Third, a real three dimensional object can have internal support structures that are themselves real three dimensional objects. For example, a hollow cube with internal pillars where each pillar has substantial length, width, and thickness is a "real" three dimensional object that can never be produced by existing textile knitting machines. Therefore, conventional knitting machines cannot produce truly three dimensional objects.

Another shortcoming of all of the known art discussed above is lack of a software application specifically tailored to dissecting a three dimensional virtual model and translating the data to run a machine for fabrication of arbitrary composite three dimensional objects. To be sure, some conventional knitting machines are controlled by electronic pattern control systems. However, the pattern control systems can only generate two dimensional knitted textile.

The patents and an article discussed below demonstrate the present day status of related art. As shown by these patents and the article, the present day technology does not offer a solution to the shortcomings of the related art in fabricating composite, arbitrary, and truly three dimensional objects.

U.S. Pat. No. 4,631,931 to Banos ("Banos '931") discloses a device for knitting a "section element" of a composite material. Banos '931 uses two knitting heads to define the outer shape of a desired section element. Threads are knitted around rods in two orthogonal planes to fabricate the cross-sectional shape of the desired section element.

U.S. Pat. No. 4,779,429 to Banos ("Banos '429") discloses a method for knitting a section element of a composite material. Each cross section of the knitted section element consists of several rectangular surfaces connected together. Each rectangular area corresponds to a series of needles in a knitting head.

U.S. Pat. No. 4,183,232 to Banos et al ("Banos '232") discloses a machine for three dimensional weaving of reinforcements. Banos '232 discloses making a three dimensional weave with a triple set of rods and yarns woven with these rods at a fixed point in front of which the rods move while turning around the axis of rotation. Banos '232 discloses fabrication of reinforcements of cylindrical, conical, or cylindro-conical ones.

U.S. Pat. No. 4,019,036 to Hiramatsu et al ("Hiramatsu") discloses an apparatus for applying patterning signals to an electrical patterning device.

U.S. Pat. No. 4,078,253 to Kajiura et al ("Kajiura") discloses a pattern generating system. Kajiura discloses conversion of a pattern drawn on a sheet into digital signals and applying the digital signals to a knitting machine.

U.S. Pat. No. 5,246,039 to Fredriksson ("Frediiksson") discloses a textile machine control system. FIGS. 9 through 11 of Fredriksson along with column 11, line 19 through column 15, line 23 disclose examples of flat knitting apparatus that interface with the textile machine control system.

U.S. Pat. No. 4,292,820 to Ragoza et al ("Ragoza") discloses an apparatus for knitting the heel of a hosiery article. U.S. Pat. No. 4,393,669 to Cahuzac ("Cahuzac '669") discloses a lacing machine for making pieces with multidirectional woven reinforcement. U.S. Pat. No. 4,505,134 to Essig ("Essig '134") discloses a knitting machine having two flat needle beds. U.S. Pat. No. 4,555,918 to Cahuzac ("Cahuzac '918") discloses a needle used in knitting yarns where the needle has an openable eye. U.S. Pat. No. 5,524,461 to Nielsen et al ("Nielsen") discloses a control system for yarn feed gearbox. U.S. Pat. No. 5,484,983 to Roell ("Roell") discloses an electric heating element in a knitted fabric. U.S. Pat. No. 5,553,470 to Hohne et al ("Hohne") discloses a wrap knitting machine.

U.S. Pat. No. 5,575,162 to Gray et al ("Gray") discloses an apparatus for controlling twist in a knitted fabric. U.S. Pat. No. 5,626,037 to Jeffcoat ("Jeffcoat") discloses a method for determining the shape of a knitting pattern. U.S. Pat. No. 5,682,771 to Forest et al ("Forest") discloses a knitted cover for vehicle seat. U.S. Pat. No. 5,692,399 to Takahashi et al ("Takahashi") discloses a method for knitting fabric. U.S. Pat. No. 3,772,647 to Christiansen ("Christiansen") discloses a method for data verification for electronic knitting machine. U.S. Pat. No. 3,790,704 to Collomosse et al ("Collomosse") discloses a pattern control system for controlling textile machinery. U.S. Pat. No. 3,818,724 to Bourgeois ("Bourgeois") discloses a data programming device for control of knitting machines.

U.S. Pat. No. 4,018,064 to Doslik ("Doslik") discloses an electronic control of knitting machines. U.S. Pat. No. 4,199,965 to Wilson ("Wilson") discloses a yarn feed control system. U.S. Pat. No. 4,114,405 to Bartels ("Bartels") discloses a control unit for a hand knitter. U.S. Pat. No. 4,890,462 to Essig ("Essig '462") discloses a knitted fabric.

An article entitled "New Technique For Knitting Solid 3-D Structures" authored by E. Sheffer and T. Dias and published in the United Kingdom discusses use of textile structures as reinforcement structures in a three dimensional matrix and placement of such textile structures in a predefined orientation within the three dimensional matrix. This articles recommends vertical displacement between a great number of needle bars to ensure sufficient space for the knitted layers to be formed at the back side of the needles without interference from neighboring needle bars. The article also recommends guide bars that are placed between the needle bars where the guide bars have a spatial compound movement to allow their tips to deposit yarn on the front and back sides of the needles and also connect a knitted layer to the neighboring ones.

Therefore, there is serious need in the art for a computer driven method and apparatus for fabrication of real three dimensional objects which can have a thickness equal to, or greater than, their respective lengths or widths. There is also serious need in the art for a computer driven method and apparatus for fabrication of real three dimensional objects where the objects can be solid or hollow and where the objects can have internal support structures which are themselves real three dimensional objects. There is further need in the art for software that is specifically tailored to dissect a three dimensional virtual model and translate the data to run a machine for fabrication of arbitrary composite three dimensional objects. Moreover, there is need in the art for fabrication of arbitrary composite objects of composite (i.e. more than one) material. Also, there is serious need in the art for a machine that can mass manufacture arbitrary three dimensional objects.

SUMMARY OF THE INVENTION

The present invention is a method and apparatus for fabrication of composite and arbitrary three dimensional objects. The invention overcomes the shortcomings of the prior art and fills the serious need in the art for a computer driven method and apparatus for fabrication of real three dimensional objects which can have a thickness equal to, or greater than, their respective lengths or widths. The invention also meets the serious need in the art for a computer driven method and apparatus for fabrication of real three dimensional objects where the objects can be solid or hollow and where the objects can have internal support structures which are themselves real three dimensional objects. The invention also includes a custom control software that is specifically tailored to run the invention's object generator for fabrication of arbitrary composite three dimensional objects. Moreover, the present invention's object generator can fabricate arbitrary objects of composite (i.e. more than one) material. The invention can also be used to mass manufacture arbitrary three dimensional objects.

In its preferred embodiment, the invention's object generator utilizes two frames, a y-frame that is atop an x-frame. The y-frame is divided into two halves. Each half of the y-frame contains a number of needles and latches. The needles in one half of the y-frame are opposed by the needles in the other half of the y-frame. The needles and latches in the y-frame are operated by magnetic actuators. Similarly, the x-frame is divided into two halves. Each half of the x-.frame contains a number of needles and latches. The needles in one half of the x-frame are opposed by the needles in the other half of the x-frame. The needles and latches in the x-frame are operated by magnetic actuators.

The invention also includes a "head" which comprises a bobbin/tensioning mechanism along with other components. The object generator's head is movable to any location on a grid (i.e. the overlapped portion) formed by the y-frame and x-frame. The head dispenses yarn and colors particular segments of yarn, both under direction of a custom control software. A computer operating the invention's object generator has stored therein a three dimensional image of the object to be generated. The computer dissects the three dimensional image into two dimensional layer data. The computer and the custom control software feed the two dimensional layer data, layer by layer, to the invention's object generator.

Under commands of the computer and the custom control software, the needles and latches of the invention's object generator perform various knitting actions on the yarn that is colored and dispensed by the object generator's head. Thus, the needles and latches generate two dimensional layers corresponding to the two dimensional layer data received from the computer. The two dimensional layers are built upon one another and gradually form a three dimensional object that is passed down below the x-frame. The three dimensional object being generated is supported by a lowering mechanism that bears the weight of the three dimensional object as it is being generated. The invention includes many other novel features and advances over the art that are explained in the detailed description of the invention of this application.

DETAILED DESCRIPTION OF THE INVENTION

The present invention is a method and apparatus for fabrication of composite and arbitrary three dimensional objects. Although the invention is described with respect to certain specific embodiments, the principles of the invention, as defined by the claims appended herein, can obviously be applied beyond the specifically described embodiments. Moreover, in the description of the present invention, certain details have been left out in order to not obscure the inventive aspects of the invention. The details left out are within the knowledge of a person of ordinary skill in the art and can be filled in by such a person.

I. Basic Components of the Present Invention

Figure 1A:
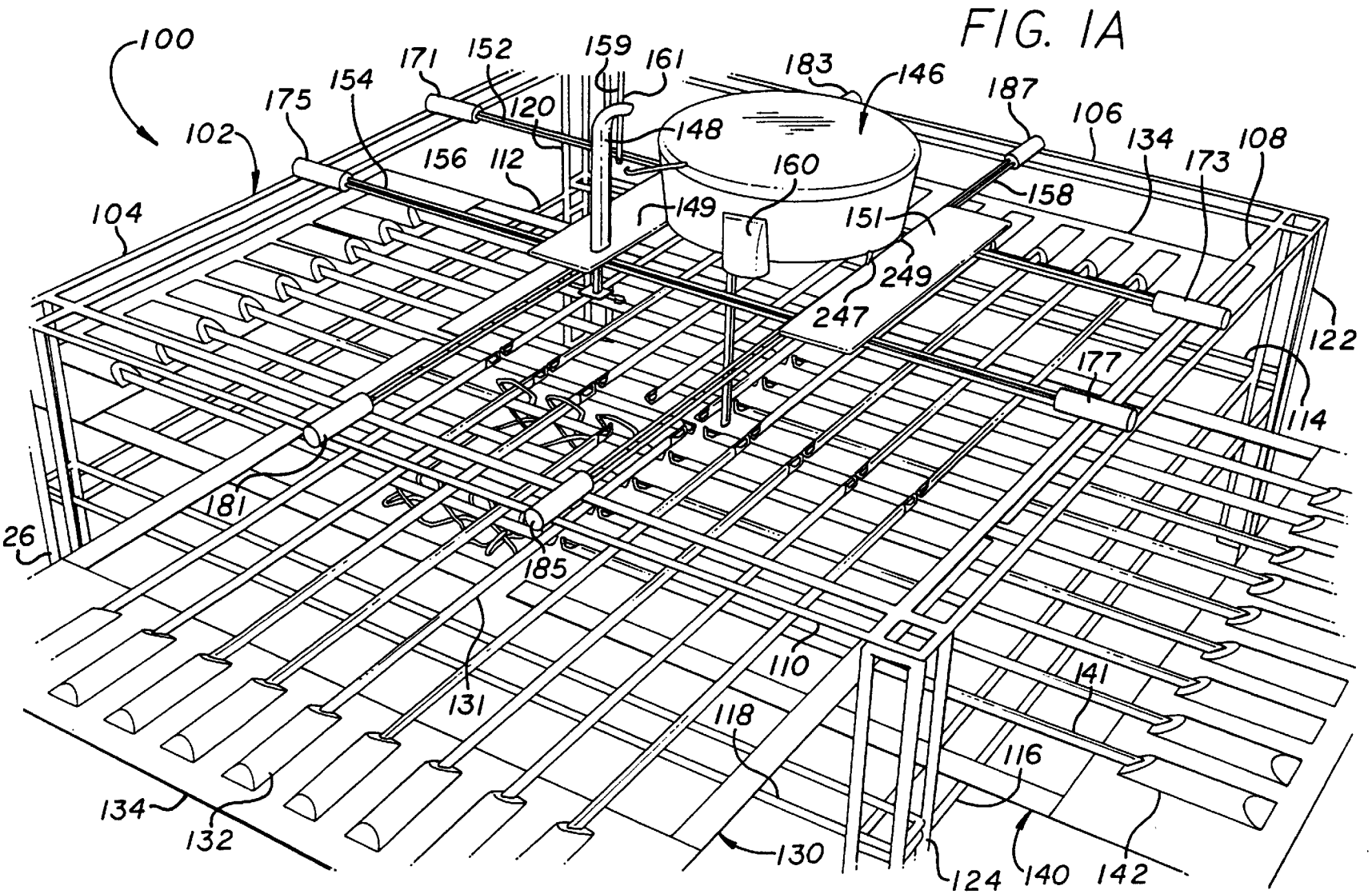
FIG. 1A illustrates a perspective view of the invention's object generator, showing some of the invention's components.
Figure 1B:
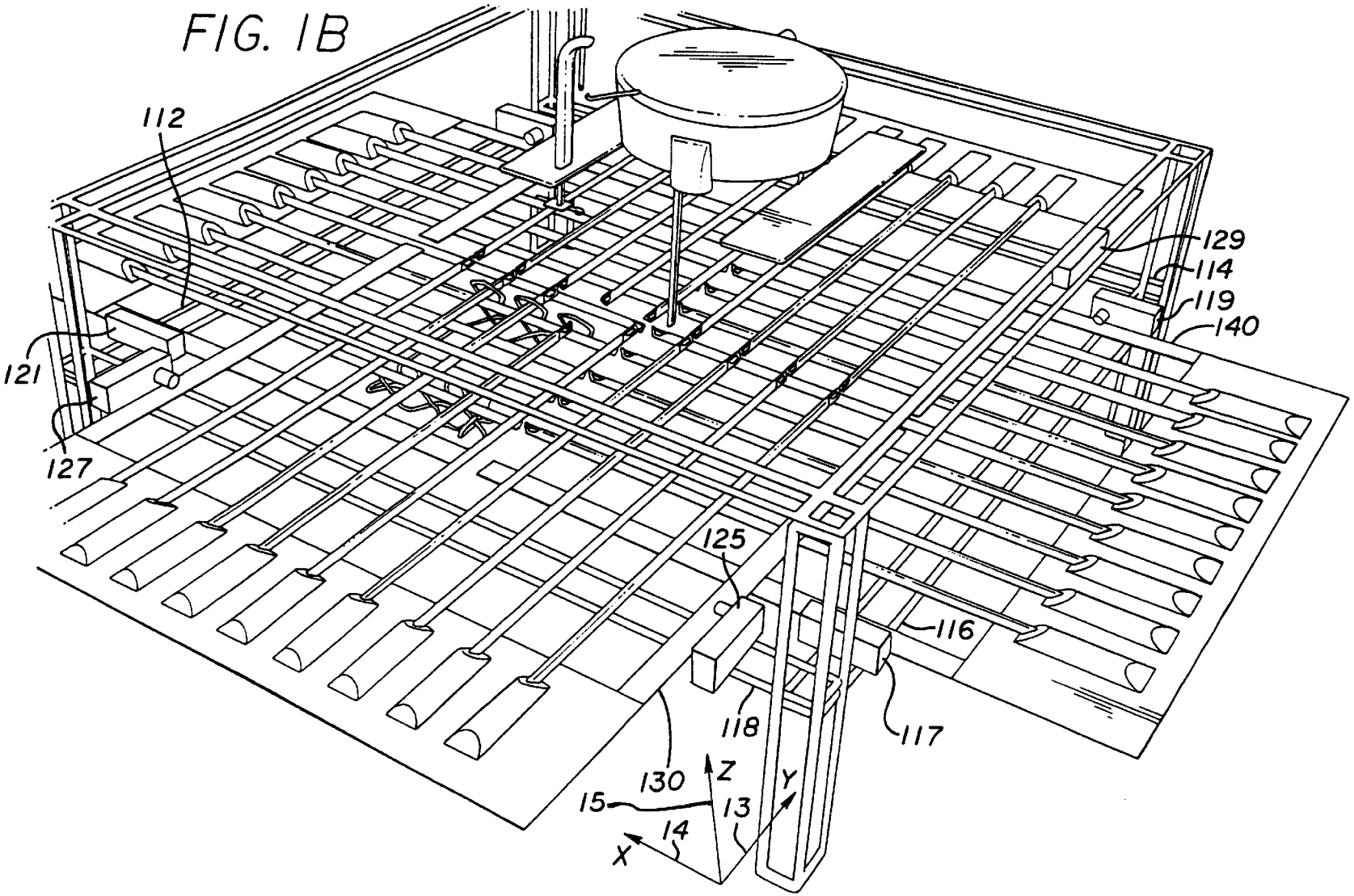
FIG. 1B illustrates another perspective view of the invention's object generator, showing some of the invention's components.

FIGS. 1A and 1B illustrates a perspective view of an embodiment of the invention. Although some features and aspects of the invention may not be readily apparent from FIGS. 1A and 1B, other Figures in the present application illustrate further features and aspects of the present invention. FIG. 1A shows three dimensional object generator (also referred to as "object generator" in this application) 100 of the invention. Object generator 100 is comprised of primary frame 102 which resembles a table with no top surface. Primary frame 102 is in turn comprised of top horizontal bars 104, 106, 108, and 110 and bottom horizontal bars 112, 114, 116, and 118. Primary frame 102 is also comprised of legs 120, 122, 124, and 126 as shown in FIG. 1A.

Object generator 100 is also comprised of Y-frame 130 which is located over x-frame 140. Both y-frame 130 and x-frame 140 are divided in their centers as shown in FIG. 1A. In other words, y-frame 130 is comprised of two symmetrical halves that maintain a fixed (but small) distance therebetween. Similarly, x-frame 140 is comprised of two symmetrical halves that also maintain a fixed (but small) distance therebetween. X-frame 140 is located slightly above bottom horizontal bars 112 and 116. One half of x-frame 140 is supported and driven by motors 117 and 119 as shown in FIG. 1B (none of the motors is shown in FIG. 1A to avoid overcrowding of that Figure). The other half of x-frame 140 is supported and driven by motors 121 (shown in FIG. 1B) and 123 (not shown in FIG. 1B). As shown in FIG. 1B, motors 117 and 119 are supported by bottom horizontal bar 116 while motors 121 and 123 are supported by the bottom horizontal bar 112. As shown in FIG. 1A, y-frame 130 is located slightly above x-frame 140. As shown in FIG. 1B, one half of y-frame 130 is supported and driven by motors 125 and 127. The other half of y-frame 130 is supported and driven by motors 129 (shown in FIG. 1B) and 229 (not shown in FIG. 1B). As shown in FIG. 1B, motors 125 and 127 are supported by bottom horizontal bar 118 while motors 129 and 229 are supported by bottom horizontal bar 114.

As shown in FIG. 1A, y-frame 130 is comprised of a number of y-axis needles 131 and x-frame 140 is comprised of a number of x-axis needles 141 (the x-axis needles are also called dividers in the present application). Y-axis needles 131 are driven by needle control portion of magnetic actuators 132. Magnetic actuators 132 are mounted on actuator support segment 134 of y-frame 130. Each magnetic actuator 132 is comprised of a needle control portion (not shown in the Figures) and a latch control portion (not shown in the Figures). Likewise, x-axis needles 141 are driven by needle control portion of magnetic actuators 142. Magnetic actuators 142 are mounted on actuator support segment 144 of x-frame 140. Each magnetic actuator 142 is comprised of a needle control portion (not shown in the Figures) and a latch control portion (not shown in the Figures).

Other components of object generator 100 shown in FIG. 1A include bobbin/tensioning mechanism 146, yarn clearing wheel sets 247 and 249, lift hook control mechanism 148, high-y rail 152, low-y rail 154, high-x rail 156, low-x rail 158, high x-rail head 149, and low x-rail head 151. High-y rail 152 is supported and driven by motors 171 and 173 which are in turn supported by top horizontal bars 104 and 108 respectively. Low-y rail 154 is supported and driven by motors 175 and 177 which are in turn supported by top horizontal bars 104 and 108 respectively. High-x rail 156 is supported and driven by motors 181 and 183. Motors 181 and 183 are in turn supported by top horizontal bars 110 and 106 respectively. Low-x rail 158 is supported and driven by motors 185 and 187. Motors 185 and 187 are in turn supported by top horizontal bars 110 and 106 respectively.

As shown in FIG. 1A, object generator 100 also includes two adjacent and identical lift hooks 159 and 161, feed box 160. Some of the components of object generator 100 of the invention are not illustrated or discussed in relation to FIGS. 1A and 1B since it is difficult to show those other components without overcrowding FIGS. 1A and 1B with too many components and numerals.

Also shown in FIG. 1B is the direction of x, y, and z axes. As shown in FIG. 1B, x axis 14 is aligned with x-frame 140, while y axis 13 is aligned with y-frame 130, while z axis 15 is perpendicular to the plane formed by the x and y axes. Stated differently, the x and y axes form a plane that is parallel to the ground that supports object generator 100, while the z axis is perpendicular to the ground that supports object generator 100.

Figure 2:
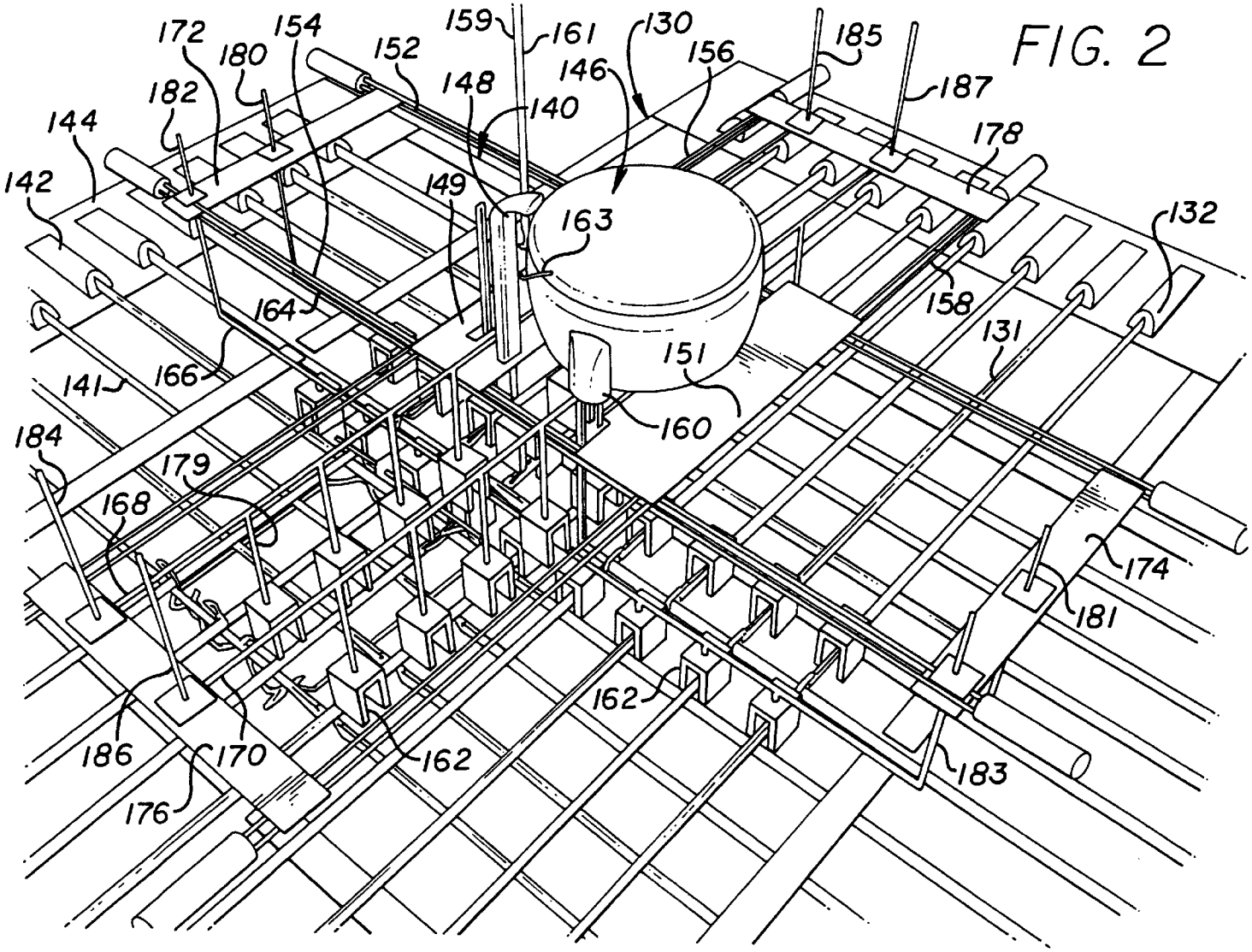
FIG. 2 illustrates a perspective view of the invention's object generator, showing some of the invention's components.

FIG. 2 illustrates a "close-up" of some of the components of object generator 100 shown in FIGS. 1A and 1B. FIG. 2 also illustrates the components of the present invention from an angle different from that of FIGS. 1A and 1B and also shows some of the components not shown in FIGS. 1A and 1B. FIG. 2 shows the following components of object generator 100 that were also shown in FIGS. 1A and 1B. The components are y-frame 130, x-frame 140, y-axis needles 131, and x-axis needles 141. FIG. 2 also shows magnetic actuators 132 and actuator support segment 134 of y-frame 130. Also shown are magnetic actuators 142 and actuator support segment 144 of x-frame 140. Other components of object generator 100 that are shown in FIG. 2 are bobbin/tensioning mechanism 146, lift hook control mechanism 148, high-y rail 152, low-y rail 154, high-x rail 156, low-x rail 158, high x-rail head 149, and low x-rail head 151. Also shown are lift hooks 159 and 161 and feed box 160. The assembly of bobbin/tensioning mechanism 146, lift hook control mechanism 148, high x-rail head 149, low x-rail head 151, lift hooks 159 and 161, and feed box 160 is referred to in this application as the "object generator head" or simply as the "head."

In addition to the above components which were also shown in FIGS. 1A and 1B, FIG. 2 shows sinkers 162, knot hook 163, high-y sinker rail 164, low-y sinker rail 166, high-x sinker rail 168, and low-x sinker rail 170. FIG. 2 also shows y-sinker rail support segments 172 and 174, and x-sinker rail support segments 176 and 178. Thus, object generator 100 has a total of four sets of sinkers 162. Two sets (i.e. high-x sinker rail 168 and low-x sinker rail 170) move along the x-axis while the other two sets (i.e. high-y sinker rail 164, low-y sinker rail 166) move along the y-axis. Each sinker 162 in object generator 100 is held by a sinker rod 179. Sinker actuators 180 and 181 at the two ends of high-y sinker rail 164 and sinker actuators 182 and 183 at the two ends of low-y sinker rail 166 are responsible for lowering and lifting high-y sinker rail 164 and low-y sinker rial 166 respectively. Similarly, sinker actuators 184 and 185 at the two ends of high-x sinker rail 168 and sinker actuators 186 and 187 at the two ends of low-x sinker rail 170 are responsible for lowering and lifting high-x sinker rail 168 and low-x sinker rail 170 respectively.

Figure 3:
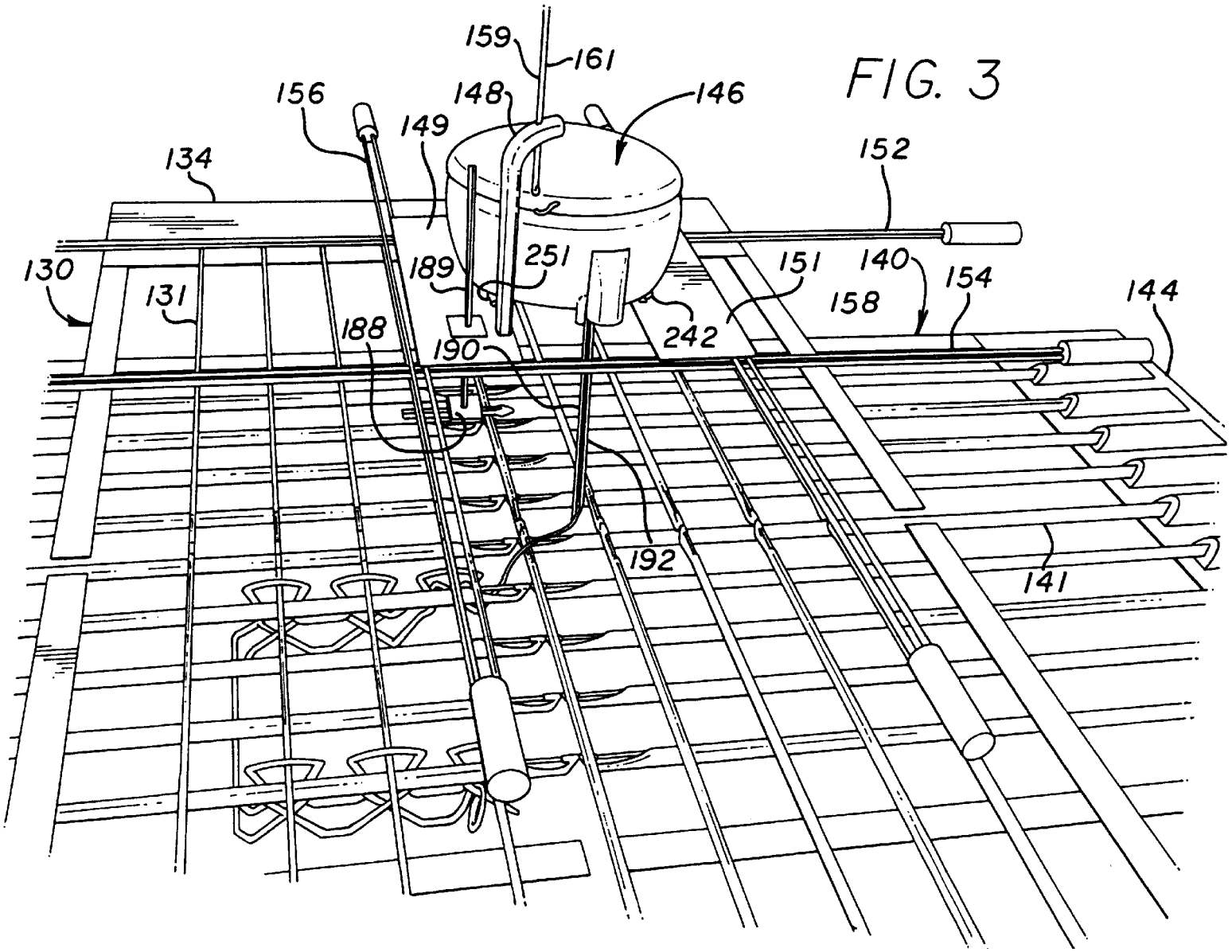
FIG. 3 illustrates a perspective view of the invention's object generator, showing some of the invention's components.

FIG. 3 shows various components of the invention shown in FIGS. 1 and 2. Some components like sinkers 162 and their associated sinker rails and sinker rods are not shown in FIG. 3 so that other parts of the invention's object generator can be seen more clearly. Accordingly, FIG. 3 is for the purpose of illustrating the present invention and is not a complete object generator of the present invention. One component of the invention shown in FIG. 3 is holder 188. Holder 188 is lowered and lifted by holder actuator 189. Holder 188 is also capable of making slight movements along side x-axis needles 141. FIG. 3 also illustrates yarn feed guide 190 and yarn 192 being fed by yarn feed guide 190 to x-axis needles 141 and y axis needles 131. The yarn fed to the needles is used to perform a three dimensional knitting action in a manner that will be described in a later section of the present application. Also shown in FIG. 3 is yarn clearing wheel set 251 that could not be shown in the previous FIGS. 1A, 1B, and 2.

Figure 4:
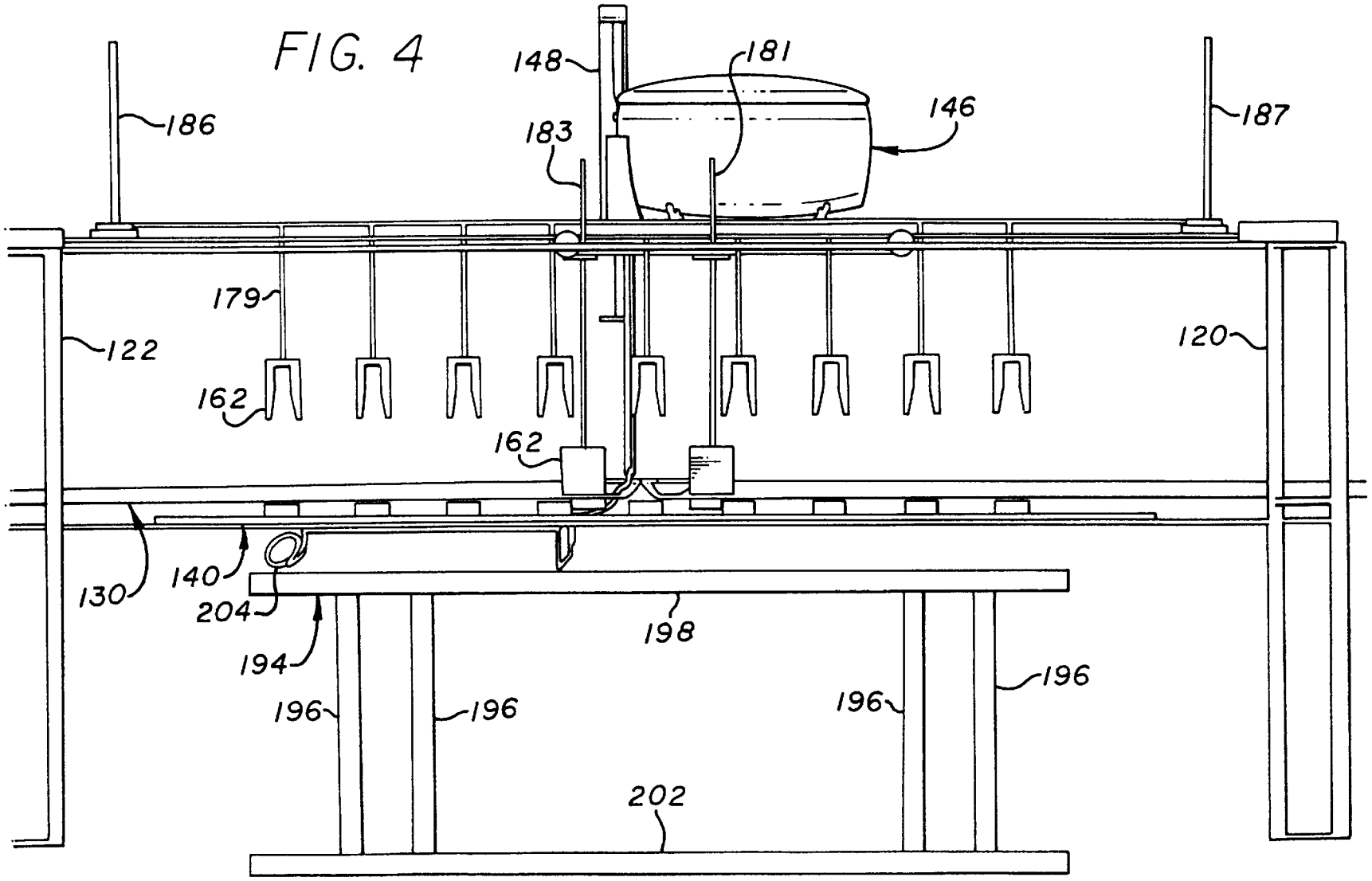
FIG. 4 illustrates a side view of the invention's object generator, showing some of the invention's components.

FIG. 4 illustrates other components of the present invention and, unlike FIGS. 1, 2, and 3 which showed perspective views of object generator 100, FIG. 4 shows a side view of object generator 100. In relation to FIG. 1, FIG. 4 is a side view of a person having leg 122 of the primary frame of object generator 100 (shown in FIG. 1) on his or her left hand side and leg 120 (shown in FIG. 1) on his or her right hand side while legs 124 and 126 (shown in FIG. 1) are blocked from view by legs 122 and 120 respectively. Now referring only to FIG. 4, besides legs 122 and 120 the following components of object generator 100 are also shown: y-frame 130, x-frame 140, bobbin/tensioning mechanism 146, lift hook control mechanism 148, actuators 181 and 183 (while they block from view, respectively, actuators 180 and 182), and actuators 186 and 187 (while they block from view actuators 184 and 185, respectively).

Also shown in FIG. 4 are sinkers 162 along with their respective sinker rods 179. FIG. 4 also shows lowering mechanism 194 of object generator 100. Lowering mechanism 194 is situated directly below x-frame 140 and is comprised of upper surface 198 and lower support surface 202 and a number of support legs 196. Lowering mechanism 194 is used to support three dimensional object 204 as it is being formed by object generator 100 in a manner explained in a later section of the present application. While upper surface 198 can move up and down, lower surface 202 is stationary and supported by a stationary surface such as a work bench, a table, or the floor.

Figure 5:
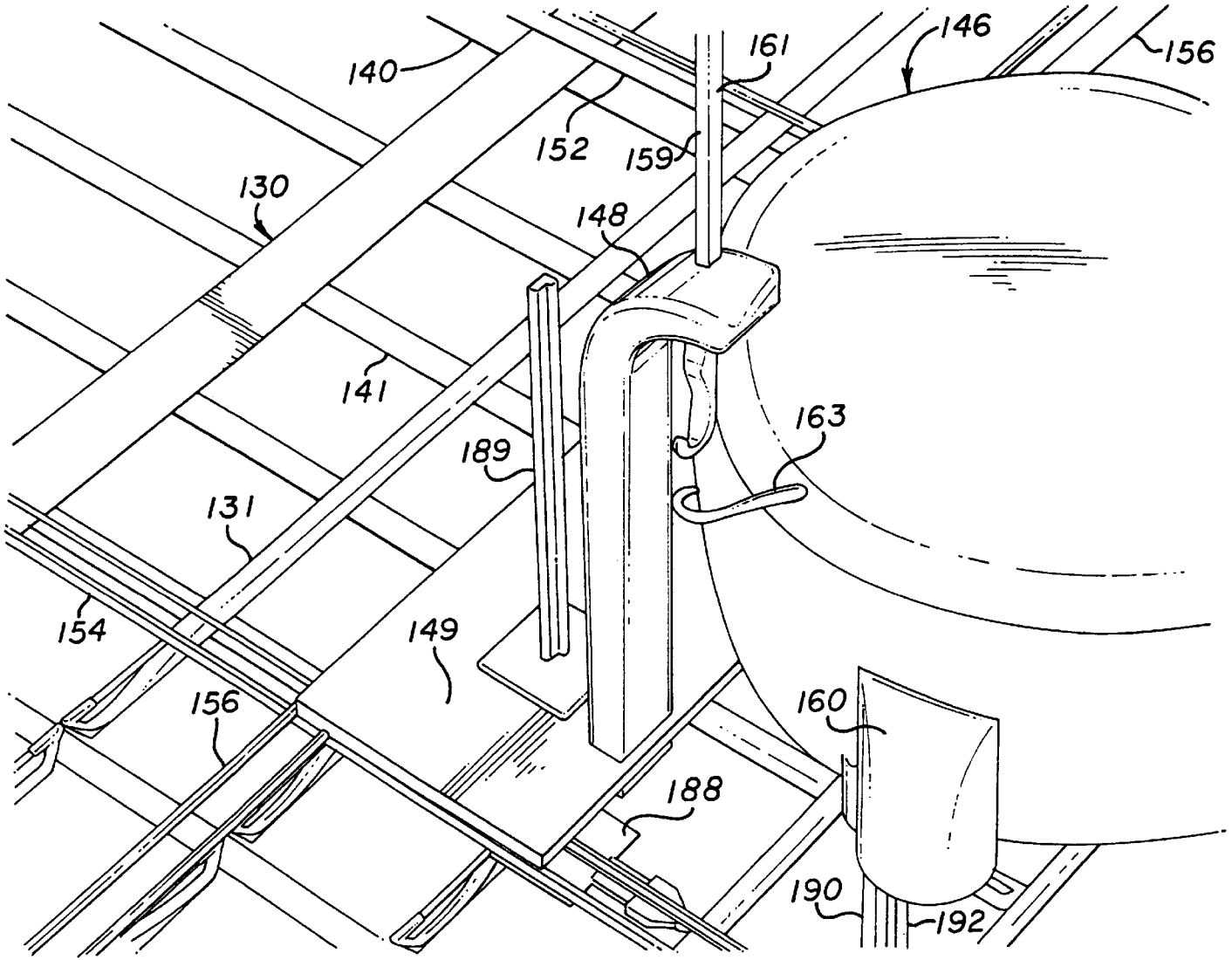
FIG. 5 illustrates a close up of the invention's bobbin/tensioning mechanism, lift hooks, lift hook control mechanism, and other components of the invention.

FIG. 5 is a close up of bobbin/tensioning mechanism 146, lift hooks 159 and 161, lift hook control mechanism 148, knot hook 163, high x-rail head 149, holder 188, holder actuator 189, feed box 160, feed guide 190, yarn 192, x-frame 140, y-frame 130, y-axis needles 131, x-axis needles 141, high-y rail 152, low-y rail 154, and high-x rail 156.

Figure 6:
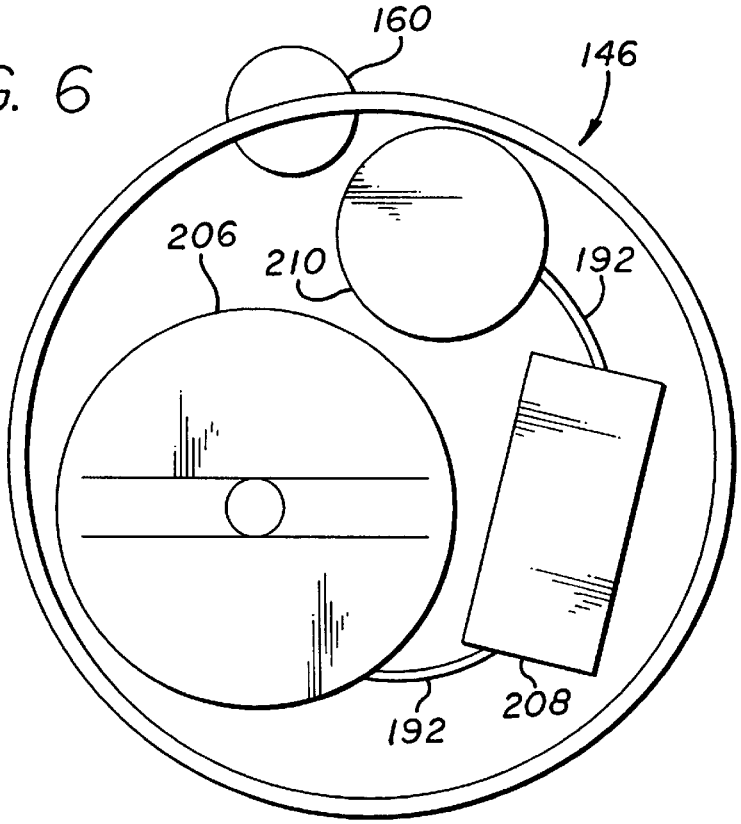
FIG. 6 illustrates the inside top view of the invention's bobbin/tensioning mechanism.
Figure 7:
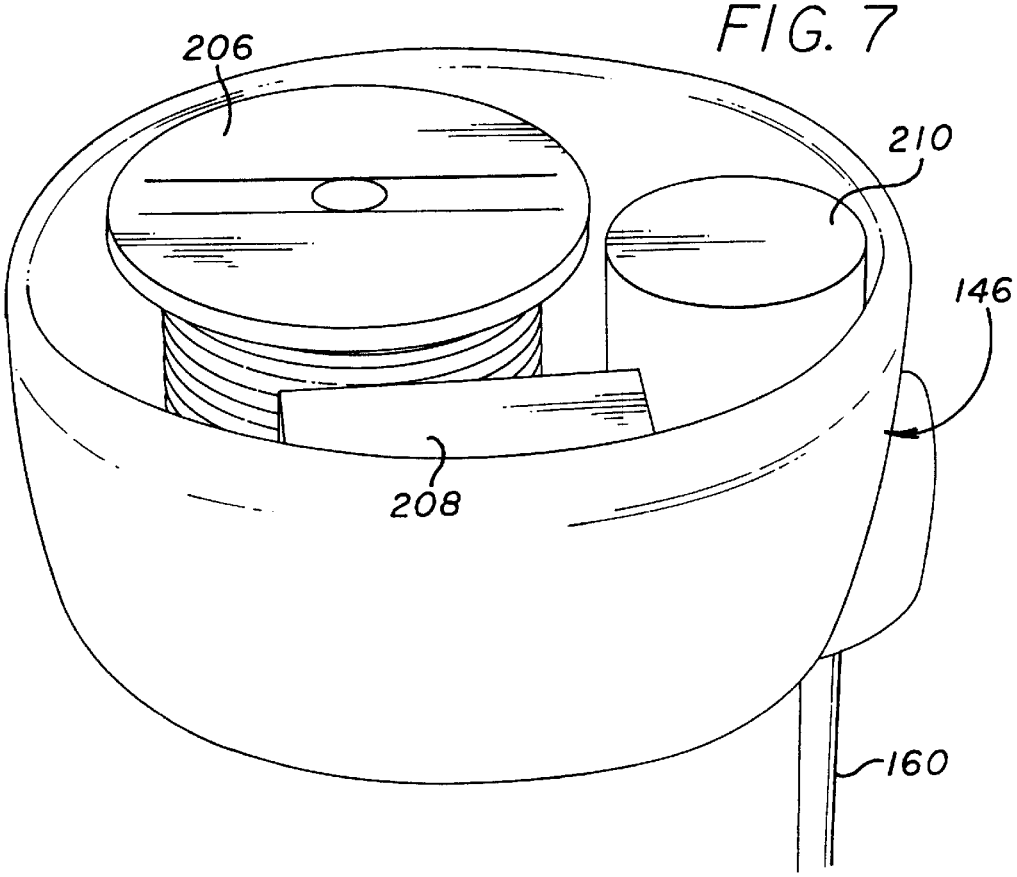
FIG. 7 illustrates the inside side view of the invention's bobbin/tensioning mechanism.

FIG. 6 is a top view of bobbin/tensioning mechanism 146 with its cover off. The internal components of bobbin/tensioning mechanism 146 as shown in FIG. 6 are yarn spool 206, printer jet 208, and tension control 210. Also shown in FIG. 6 is a top view of feed box 160. FIG. 7 is a side view of bobbin/tensioning mechanism 146 with its cover off. The internal components of bobbin/tensioning mechanism 146 as shown in FIG. 7 are yarn spool 206, printer jet 208, and tension control 210. FIG. 7 also shows a side view of feed box 160.

Not shown in any of the Figures is a motor inside bobbin/tensioning mechanism 146 attached to the bobbin casing. The motor engages the bobbin's top and can rotate the bobbin's top during knotting operations.

II. Some Basic Terminology Used in the Invention

Prior to a detailed description of the operation of the present invention, some knitting terminology used in the present invention is defined. Knitting by interweaving refers to a process where, for each layer of the three dimensional object, two sets of straight yarns cross and interweave at right angles to each other. Knitting by intertwining refers to a process where, for each layer of the three dimensional object, yarns are caused to intertwine with other yarns. Knitting by intertwining includes techniques such as braiding and twisting. Knitting by interlooping refers to forming yarns into loops each of which is held by a needle and released only after a succeeding loop has been formed and intermeshed with it. The loops are also held together by the yarn passing from one loop to the next. Knitting by interlooping is the method used in the preferred embodiment of the present invention and is therefore the only method of formation a three dimensional object according to the present invention that is described in the present application.

Yarn is the raw material manipulated during the knitting action of the present invention. The yarn typically consists of filaments of substantial length and small cross section of a particular material. The material can be plastic, metal, fiber, or any other material that can be shaped in the form of a yarn.

Figure 8:
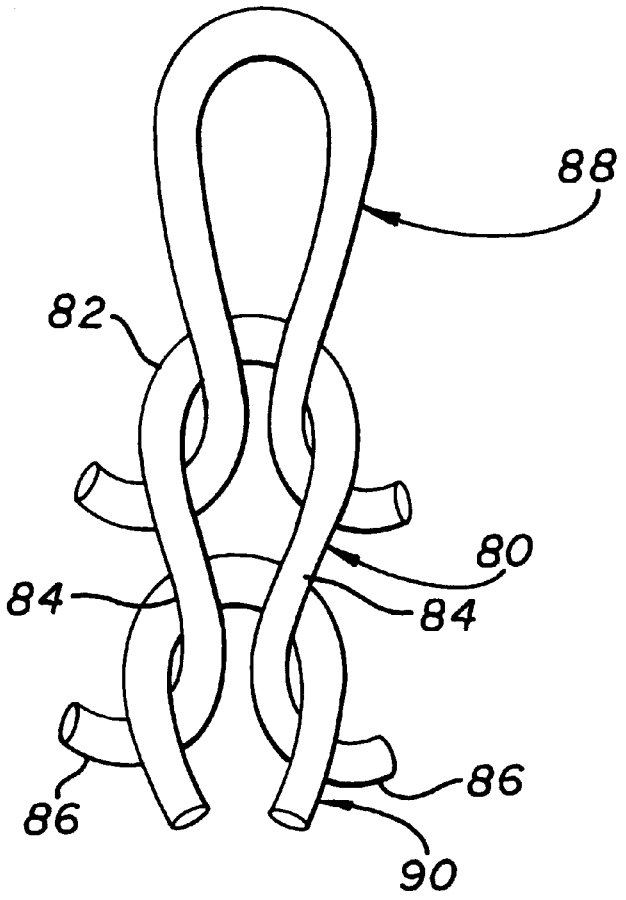
FIG. 8 illustrates a stitch.

According to the present invention, a "stitch" is the simplest unit of a knitted three dimensional object. A stitch consists of a head and two side legs. At the base of each leg is a foot which meshes through the head of the stitch (or loop as the case may be) formed at the previous knitting cycle of the needle. The yarn passes from the foot of one stitch formed by it into the foot and leg of the next stitch formed by it. FIG. 8 shows a stitch 80 with head 82, two legs 84, two feet 86. Also shown in FIG. 8 are stitch 88 which is on top of stitch 80 and a portion of stitch 90 which is below stitch 80. As shown in FIG. 8, according to the present invention, the feet of a stitch are typically open since the yarn is typically fed in the same direction across the needles (i.e., the yarn does not return across the back of the needles).

Figure 9:
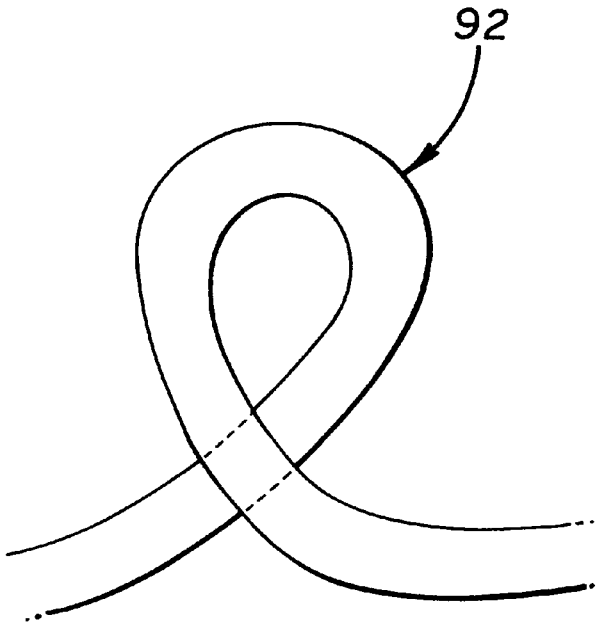
FIG. 9 illustrates a loop.

A loop is similar to a stitch in that it too consists of a head and two side legs. Also, a loop has a foot at the base of each leg. However, a loop is typically produced by twisting a stitch over as it is transferred to another needle, or twisting a stitch as the stitch is cast off. FIG. 9 shows a is a representation of a loop (loop 92) according to the present invention.

Figure 10:
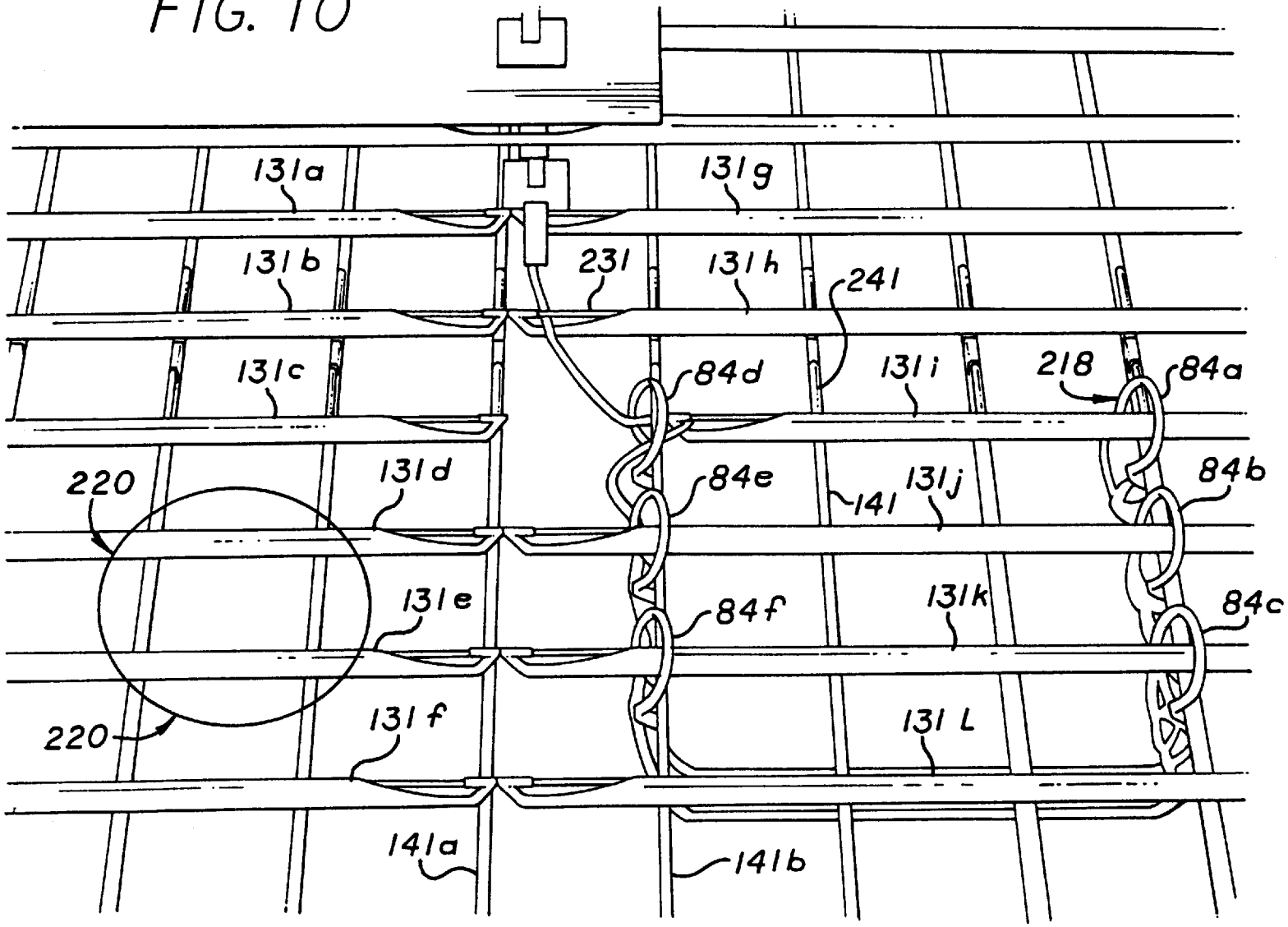
FIG. 10 illustrates a knitting course and an embodiment of the invention's needles and latches.

A "course" (also called a "knitting course") is a row of stitches produced by adjacent needles during the same knitting cycle. An example of a course is course 218 shown in FIG. 10. Course 218 is comprised of stitches 84*a,* 84*b,* and 84*c* as shown in FIG. 10.

Other terminology used in the present invention will be defined when the operation of the object generator is described below.

III. Specific Hardware of the Invention

Two different embodiments of the invention's y-axis needles 131 and x-axis needles 141 are disclosed in the present application. One embodiment of the invention's y-axis needles 131 (or x-axis needles 141) is the embodiment shown in FIG. 10. In that embodiment, each y-axis needle latch 231 extends inside the needle to the bottom of that needle and it (i.e. each latch 231) is operated by the latch control portions of magnetic actuators 132. Likewise, each x-axis needle latch 241 extends inside the needle to the bottom of that needle and it (i.e. each latch 241) is operated by the latch control portion of magnetic actuators 142. Under computer command, each one of the needle latches 231 (or 241) is opened and closed by the latch control portion of a respective magnetic actuator 132 (or 142). The reason and timing for the latches opening and closing and the sequence of computer commands causing the latches to opened and closed is discussed later in the present application.

Figure 11:
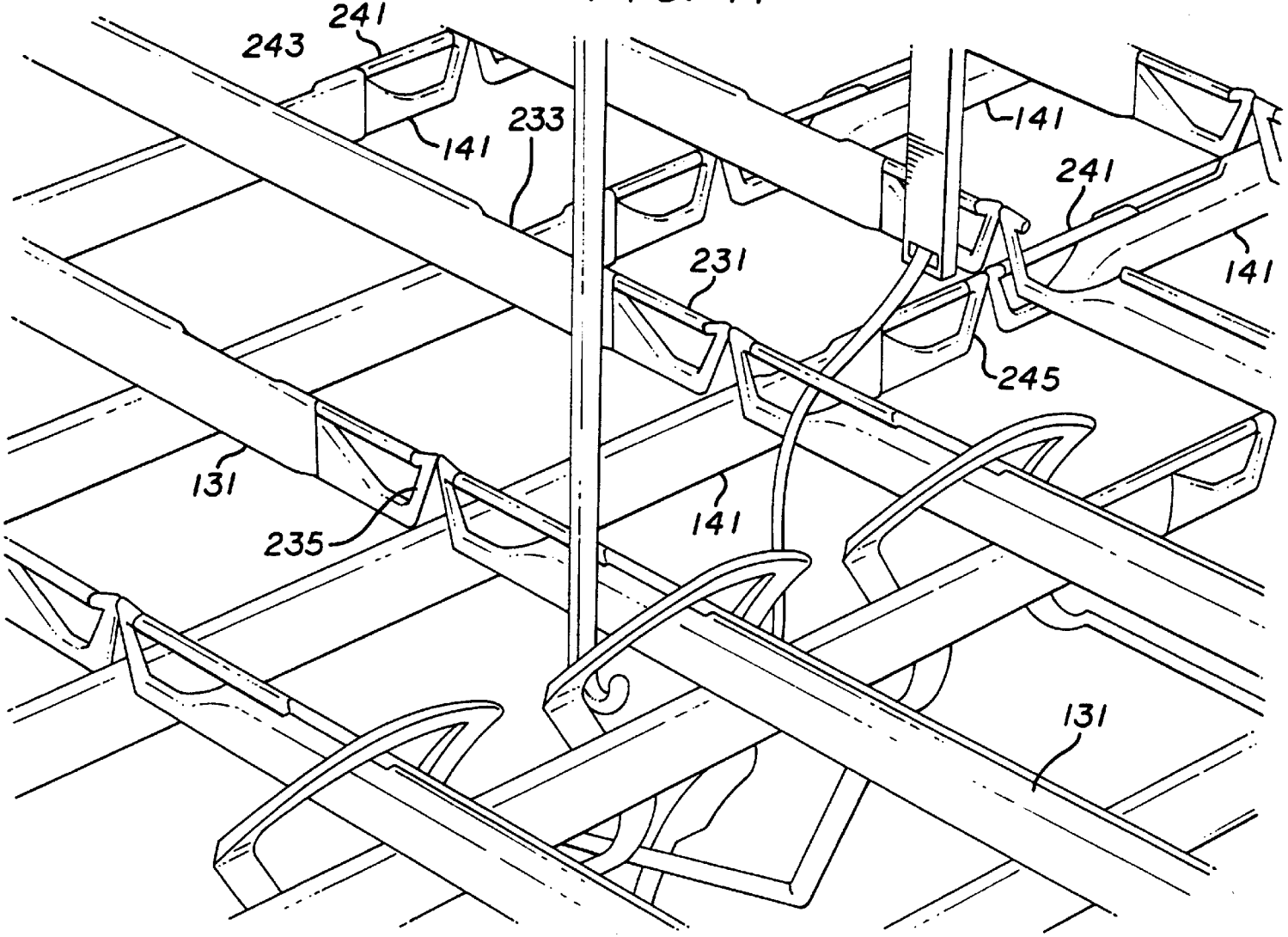
FIG. 11 illustrates a preferred embodiment of the invention's needles and latches.

A second (and preferred) embodiment of the invention's needles is shown in FIG. 11. As in previous Figures, y-axis needles are indicated by numeral 131 and x-axis needles are indicated by numeral 141 in FIG. 11. Y-axis needles 131 are equipped with latches 231 and x-axis needles 141 are equipped with latches 241. As with the embodiment of the invention's needles shown in FIG. 10, each y-axis needle latch 231 is operated by a respective latch control portion of magnetic actuators 132 and each x-axis needle latch 241 is operated by a respective latch control portion of magnetic actuators 142. However, in the case of the embodiment of FIG. 11, latches 231 (or 241) do not extend in the inside of the needles. Each latch 231 extends into a respective needle sleeve 233 and each respective sleeve 233 is driven by the respective latch control portion of a magnetic actuator 132. Similarly, each latch 241 extends into a respective needle sleeve 243 and each respective sleeve 243 is driven by the respective latch control portion of a magnetic actuator 142.

It is easier to manufacture the needle/latch/actuator combination in the embodiment of FIG. 11 than in the embodiment of FIG. 10. The reason is that the embodiment of FIG. 11 avoids the necessity for having a complicated internal structure of the needles required for housing and extending needle latches inside the needles. As with the embodiment of FIG. 10, in the embodiment of needle actuators shown in FIG. 11, computer commands individually open and close each needle latch 231 (or 241) through the latch control portion of a respective magnetic actuator 233 (or 243) placed in actuator support segment 134 (or 144). The reason and timing for the latches opening and closing and the sequence of computer commands causing the latches to opened and closed is discussed later in this application.

Referring to either FIG. 10 or FIG. 11, each needle 131 has a sloped hook 235 and each needle 141 has a sloped hook 245. Each latch 231 or 241 can be either in the open or closed state. When the latch is in the open state, the needle hooks can receive and pull yarn back for various knitting operations. When the latch is in the closed state, the needle has a relatively smooth surface from its tip to its butt. This permits stitches or loops to freely glide on the needle's surface without getting snagged by the needles' hooks. As will be explained in a later section of this application, the gliding action is necessary for casting off old stitches and/or loops, for loop transfers, and other operations of the object generator.

As shown in FIG. 1A, two sets of opposing needles 131 are housed in the two halves of y-frame 130. Similarly, two sets of opposing needles 141 are housed in the two halves of x-needle frame 140. The two halves of y-frame 130 may or may not move in the same direction and may or may not move in unison along the y axis. In other words, while the two halves of y-frame 130 change their location to perform the various knitting action of the present invention, the two halves may or may not maintain a fixed amount of separation therebetween. As shown in FIGS. 1A and 1B, y-frame needles 131 and the two halves of y-frame 130 lie slightly above x-frame needles 141 and the two halves of x-frame 140. Similarly, the two halves of x-frame 140 may or may not move in the same direction and may or may not move in unison along the x axis. In other words, while the two halves of x-frame 140 change their location to perform the various knitting actions of the present invention, the two halves may or may not maintain a fixed amount of separation therebetween.

The area where the x-frame 140 and y-frame 130 of the object generator overlap is called the "grid" of the object generator. Each constituent square (or rectangle as the case may be) that is formed by the intersection of two neighboring x-needles and two neighboring y-needles is referred to as a "grid unit." For the purpose of illustration, a grid unit is encircled and pointed to with numeral 220 in FIG. 10.

The organization of y-axis needles 131 and x-axis needles 141 in the form of a grid allows the object generator to maintain a fixed separation between stitches and loops formed during the process of generating a three dimensional object. That is, the x-axis needles 141 divide the y-axis needles 131 into a number of segments. Similarly, the y-axis needles 131 divide the x-axis needles 141 into a number of segments. Thus, the division of y-axis and x-axis needles into many segments makes possible the very fabrication of stitches and loops in response to the two dimensional layer by layer data that is passed onto the invention's object generator from the three dimensional computer model. The division of the y-axis and x-axis needles also makes possible the invention's "loop transfers" in a manner discussed below. Moreover, the x-axis needles are used as a "natural" barrier to accidental movement of stitches and loops on the y-axis. Likewise, the y-axis needles are used as a "natural" barrier to accidental movement of stitches and loops on the x-axis.

In one embodiment of the invention, each x-axis and y-axis needle is twenty inches long and each half of the y-frame and the x-frame is also twenty inches long. Accordingly, the entire y-frame spans forty inches and the entire x-frame also spans forty inches. In that embodiment, the grid formed by the intersection of the x-frame and the y-frame is a square grid of twenty by twenty inches.

Referring to FIG. 1A, bobbin/tensioning mechanism 146 rests atop high x-rail head 149 and low x-rail head 151. Bobbin/tensioning mechanism 146 holds and dispenses the yarn used in the knitting process. Referring to FIG. 6, the yarn (shown as yarn 192) is held in yarn spool 206 and after being colored by printer jet 208 is provided to feed box 160 through tension control 210. Tension control 210 is responsible for providing correct yarn tensioning during the knitting and knotting actions. As shown in FIG. 1A, the surface of bobbin/tensioning mechanism 146 is round and low friction such that yarn can be passed around bobbin/tensioning mechanism 146.

It is recalled that FIG. 1A showed two sets of clearing wheels 247 and 249, and FIG. 3 showed an additional set of clearing wheels 251. There are in fact a total of four sets of clearing wheels that support bobbin/tensioning mechanism 146 on top of high x-rail head 149 and low x-rail head 151. Three of these four sets of clearing wheels (i.e. sets 247, 249, and 251) have been shown in the Figures as stated above while the fourth set of clearing wheels (set 253) is not shown in any of the Figures. Each set of clearing wheels 247 and 249 is comprised of two opposing wheels, one of the wheels being mounted on low x-rail head 151 and the other being mounted on the bottom surface of bobbin/tensioning mechanism 146. Similarly, each set of clearing wheels 251 and 253 is comprised of two opposing wheels, one of the wheels is mounted on high x-rail head 149 while the other is mounted on the bottom surface of bobbin and tensioning mechanism 146.

The four sets of clearing wheels 247, 249, 251, and 253 placed between bobbin/tensioning mechanism 146 and high x-rail head 149 and low x-rail head 151 permit yarn to be cleared from between bobbin/tensioning mechanism 146 and the high x-rail head 149 and low x-rail head 151 when necessary. Through rotation action of each of the clearing wheels, yarn is permitted to pass through the interface between the rotating wheel mounted on a respective head rail (i.e. low-x rail head 151 or high x-rail 149) and the rotating wheel mounted on bobbin/tensioning mechanism 146. For example, yarn can be cleared from between bobbin/tensioning mechanism 146 and the high x-rail head 149 and low x-rail head 151 during the knotting process as described in a later section of this application.

As previously stated, yarn 192 is made of any type or combination of flexible material such as textile, plastic or metal. When printer jet 208 is used yarn 192 should be composed of material that accepts printer dye. The object generator can utilize different types of yarns. For example, the object generator can use textile and plastic yarns to generate a certain object. The resulting object would have a consistency similar to one made of material composed of the yarns used. In the example, the resulting material would have a consistency similar to material composed of both textile and plastic.

Prior to explaining the operation of the present invention, attention is turned to several mechanisms that are routinely used during operation of the invention's object generator. One such mechanism is called the "feeder mechanism." The feeder mechanism is comprised of feed box 160 which is attached to bobbin/tensioning mechanism 146 and feed guide 190 which is controlled by feed box 160. Feed guide 190 is used to guide and provide yarn down to the present knitting location. Feed box 160 is used to lower and lift the feed guide during various operations of the object generator. During certain operations, such as the knotting operation, feed guide 190 is also used to cut and hold yarn.

Another mechanism is the yarn holder mechanism which involves holder 188. Holder 188 can be lowered or lifted by holder actuator 189 which is attached to high x-rail head 149. The holder can also be extended along the x-axis using a holder extension actuator. Holder 188 is used to grab from the feed guide yarn that has been cut during a knotting operation as described later in this application.

IV. Operation of the Present Invention

The invention's object generator is used to fabricate arbitrary three dimensional objects. The object generator is controlled by a computer program having a three dimensional representation of the object to be fabricated. This representation can be in various "3D modeling" languages such as VRML (Virtual Reality Modeling Language). The contents of a three dimensional computer model represented in VRML can be viewed, rotated and manipulated and dissected. Other 3D modeling languages such as STL and IGES can also be used to control the invention's object generator. By way of brief background, IGES (Initial Graphics Exchange Specification) is a graphics file format that is system independent. IGES evolved out of a program called Integrated Computer Automated Manufacturing (ICAM) program developed in 1979. STL (Stereolithography) file format is used in conversion of 3D CAD model data to physical parts using RP systems.

Through the use of a 3D modeling language such as VRML, STL, or IGES, the three dimensional representation of an object to be fabricated is provided to the invention's object generator layer by layer. Each layer is a layer in the vertical or z-axis, (i.e. an axis perpendicular to the x-frame (or the y-frame) of the object generator). In other words, the object is built up in the vertical direction. As further explained below, a proprietary software interface designed for the invention's object generator determines how to orient the computer three dimensional representation of the object such that the object can be generated the quickest possible way.

The layer by layer data provided by the 3D modeling application are Esther decomposed into a two dimensional matrix of ON and OFF bits data. ON bits represent parts of the layer that are solid. OFF bits represent empty space. The extent of decomposition of the two dimensional layer data into the matrix of ON and OFF bits depends on the number of "grid units" of the object generator. The area where the x-frame 140 and y-frame 130 of the object generator overlap is called the "grid" of the object generator. Each constituent square (or rectangle as the case may be) that is formed by the intersection of two neighboring x-needles and two neighboring y-needles is referred to as a "grid unit." For the purpose of illustration, a grid unit is encircled and pointed to with numeral 220 in FIG. 10.

Thus, the number of grid units depends on the total number of x-axis needles and the total number of y-axis needles. If the total number of x-axis needles and y-axis needles per square inch is relatively large then the number of grid units is also high. In that case, a higher number of ON and OFF bits can be accommodated. Conversely, if the object generator has a relatively small number of x-axis needles and y-axis needles per square inch then the number of grid units is also low. In that case, only a small number of ON and OFF bits can be accommodated. The number of needles in the various types of the invention's object generators vary from five needles per inch to ten needles per inch for either the x-frame or the y-frame. Thus, the number of grid units per square inch can vary from twenty five grid units per square inch (when both the x-frame and y-frame have five needles per square inch) to one hundred grid units per square inch (when both the x-frame and y-frame have ten needles per square inch). While a high number of grid units permits a higher resolution, and thus a higher fineness and refinement of the generated object, a low number of grid units permits an object to be generated quicker.

Because of the fact that any given layer can be comprised of an arbitrary matrix of ON and OFF bits, each layer built in the direction of the z axis (i.e. in the vertical direction) can have an arbitrary shape. Accordingly, the shape of the final generated object will be as arbitrary as desired by the user of the present invention. Also, the size of the object generator's grid determines the size of the final object generated. The size of the grid in turn depends on the length of x-axis needles 141 and y-axis needles 131. Thus, the resolution and size of the final object is proportional to the number of needles and the size of the needles of the invention's object generator.

The invention's object generator utilizes y-frame 130 and x-frame 140 in order to fabricate each two dimensional layer of the final three dimensional object. During the operation of the invention's object generator, y-frame 130 and x-frame 140 move along the y-axis and x-axis respectively. The movement of the x-frame and y-frame permits creation of new stitches, loops, or knots at various locations of the grid. In other words, the movement of the x-frame and y-frame focuses the knitting action on a particular location in the grid. The bobbin/tensioning mechanism is also moved by the high x-rail, low x-rail, high y-rail, and low y-rail to the location of the knitting action on the grid. Moreover, the cooperation and movement of the x-frame and y-frame also permit "stitch transfer" or "loop transfer" from one half of the y-frame onto the other half, or alternatively, from one half of the x-frame onto the other half. The loop and stitch transfer operations and reasons for these operations will be discussed later in this application.

It is noted that during the movement of x-frame 140 and y-frame 130, the location of the grid is always the same, i.e. at the center of the object generator. It is also noted that individual needles 131 and 141 move only slightly from their rest position during knitting action. Thus, the movement of x-frame 140 and y-frame 130 permits x-axis needles 141 and y-axis needles 131 to reach any location on the grid. For example, if the knitting action is to performed at the very corner of the grid, the x-frame and y-frame are both moved to the greatest possible extent down the x-axis and y-axis respectively so that the x-axis needles and y-axis needles can reach the very corner of the grid.

As stated above, to build each two dimensional layer of the final three dimensional object, high x-rail head 149 and low x-rail head 151 along with bobbin/tensioning mechanism 146 move to the grid location where knitting is to be performed. This means that feed box 160 and yarn guide 190 are also moved to the current knitting location. The grid unit where the current knitting action is to take place corresponds to an ON bit in the two dimensional layer data provided from the 3D modeling program. It should be noted that the path that the bobbin/tensioning mechanism 146 travels in order to arrive at the current knitting location is dependent on the desired properties of the three dimensional object to be generated. Different paths result in different qualities and physical properties (for example, elasticity, heat conductivity, or weight) of the final generated object. The computer providing the layer by layer data to the object generator also determines the unique paths to be taken by the bobbin/tensioning mechanism 146 in order to arrive at the current knitting location. Moreover, the computer can also direct the object generator to skip needles. This would result in a more sparse structure and reduce the time required for generating the three dimensional object and also reduce the amount of yarn used to generate the object.

Referring to FIG. 10, y-axis needles 141 are used to knit stitches in the direction of x-axis. Examples of stitches knitted by y-axis needles 141 are stitches 84*a,* 84*b,* and 84*c* that make up a "course" of stitches along the x-axis designated by numeral 218. Another course knitted by y-axis needles is a course comprised of stitches 84*d,* 84*e,* and 84*f* as shown in FIG. 10. In general, all y-axis needle hooks lie within a "current knitting course." A current knitting course is defined as the course where the current knitting action is taking place. The current knitting course and, therefore, all y-axis needle hooks within the current knitting course are confined between two adjacent x-axis needles. Referring to FIG. 10, the hooks of y-axis needles 131*a,* 131*b,* 131*c,* 131*d,* 131*e,* 131*f* on one half of y-frame 130 and the hooks of y-axis needles 131*g,* 131*h,* 131*i,* 131*j,* 131*k,* and 131*l* on the other half of y-frame 130 are within the current knitting course which is confined by two adjacent x-axis needles 141*a* and 141*b*. It is important to note that the current knitting course is substantially prevented from moving in the direction of y-axis by the blocking action of the x-axis needles. In the example of the current knitting course comprised of stitches 84*d,* 84*e,* and 84*f,* the x-axis needle 141*b* and 141*a* substantially prevent any movement of that knitting course in the direction of the y-axis. In other words, the current knitting course comprised of stitches 84*d,* 84*e,* and 84*f* is kept confined between needles 141*b* and 141*a*. In fact one of the advances introduced in the present invention over the prior art is that the long x-axis and y-axis needles act as "dividers" that aid in the making, organizing, and separating a large number of loops and stitches in the present invention in the manner described earlier in the present application and in a manner further described below.

Before the process of forming stitches (such as stitches 84*d,* 84*e,* or 84*f*) is described, the action of sinkers 162 and needles 131 is now described. Sinkers 162 are used during the knitting process to press down on stitches that have already been formed and "sink" them below the newly formed stitches. In other words, by their weight and pressure, sinkers 162 ensure that the "old" stitches are "cast off" the needles within the current knitting course. As described above, once the "old" stitches are cast off, they are held by the feet of the new stitches which are formed by the needles of the current knitting course.

Generation of a course of stitches along the x-axis requires the cooperation and coordination of sinkers 162 and y-axis needles 131. Y-axis needles 131 (as well as x-axis needles 141) can assume three different states during generation of a course of stitches. In a "rest" state, y-axis needles 131 (or x-axis needles 141) are not engaged in the knitting action. This means that during the rest state the needles are not pulled back and the latches are either in the open or closed position. An example of the rest state is the state of needles 131*d,* 131*e,* 131*f,* 131*h,* 131*j,* 131*k,* or 131*l* in FIG. 10. In a "tuck" state, y-axis needles 131 (or x-axis needles 141) are engaged, usually with the yarn trapped in the needles' closed latches. In the tuck state, the needle control portion of a magnetic actuator 132 (or a magnetic actuator 142) pulls the engaged needle back relative to the needle's rest position. However, the needle is not pulled back to an extent sufficient to permit an old stitch to be cast off (i.e. to be released) from the engaged needle. As in a tuck state, in a "knit" state, y-axis needles 131 (or x-axis needles 141) are engaged, usually with the yarn trapped in the needles' closed latches. Also, in the knit state, the needle control portion of a magnetic actuator 132 (or a magnetic actuator 142) pulls the engaged needle back relative to the needle's rest position. However, in contrast with the tuck state, in the knit state the needle is completely pulled back to an extent sufficient to permit an old stitch to be cast off (i.e. to be released) from the engaged needle. In other words, in the knit state, a new stitch is formed while the old stitch is cast off from the engaged needle.

As stated above, generation of a course of stitches along the x-axis requires the cooperation and coordination of sinkers 162 and y-axis needles 131. Sinkers 162 are organized in a way such that the sinkers attached to high-x sinker rail 168 and low-x sinker rail 170 (together called the x-axis sinkers) can move along the y-axis without running into the sinkers attached to high-y sinker rail 164 and low-y sinker rail 166 (together called the y-axis sinkers). Similarly, y-axis sinkers can move along the x-axis without running into the x-axis sinkers. The x-axis and y-axis sinkers can assume four different states during generation of a course of stitches. In a "retract" state, all sinkers have been retracted up (i.e. up in the direction of the z-axis) by the action of sinker actuators. The retract state is used when the sinkers are not needed at all, such as during the knotting process (to be described). In a "clear" state, the sinkers are ready to be engaged and are placed slightly above the x-axis and y-axis needles through the action of the sinker actuators. In a "hold" state, the sinkers are lowered so as to press down on the existing stitches in the current knitting course while new stitches are being generated. In the hold state, the sinkers result in holding the existing stitches in place while yarn is being pulled (i.e. knitted) through them. The hold state also causes the existing stitches to be cast off as "old" stitches after yarn has been pulled (i.e. knitted) through them. Once the needle has been completely pulled back (i.e. the needle is in the knit state) and "old" stitches have been cast off, the sinkers are lowered further to their "block" state (thus, in the block state, the sinkers are lowered relative to the hold state). As the needle returns from its knit position to a rest position, the latch control portion of a magnetic actuator 132 (or a magnetic actuator 142) opens the needle's latch while a sinker in its block position prevents the newly formed stitch from moving forward. This results in the newly formed stitch to be pushed outside of the needle's hook. After the newly formed stitch is placed completely outside the needle's hook, the latch control portion of a magnetic actuator 132 (or a magnetic actuator 142) would close the needle's latch. In the next knitting cycle, this newly formed stitch becomes an "existing stitch" and is cast off as an "old stitch" during the hold state of the sinkers in the manner described immediately above.

The knitting action of the invention's object generator when the current knitting course lies in the direction of the x-axis (i.e. when the y-axis needles are performing the knitting action) and the knitting action of the invention's object generator when the current knitting course lies in the direction of the y-axis (i.e. when the x-axis needles are performing the knitting action) are similar. When the current knitting course lies in the direction of the x-axis, the high x-rail head 149, low x-rail head 151, bobbin/tensioning mechanism 146, and feed box 160 move together to the y-axis needle where a new stitch is to be generated. The y-axis needle's latch is then opened and yarn is delivered through feed guide 190 to the needle's hook. The x-axis sinkers are then lowered to their hold position to keep the existing stitch on the y-axis needle in place while the new stitch is being generated. The remainder of the process of generating the new stitch and casting off the existing (i.e. "old") stitch was discussed above in relation to the operation of sinkers 162. The process of generating stitches in the y-axis direction (i.e. generating stitches using x-axis needles) is similar to that described above for generating stitches in the x-axis direction.

In order to begin the process of generating a three dimensional object, it is typically required that a "first knot" be created. Knots are necessary in order to tie up the loose yarn such that the three dimensional object can have a stable structure and so that the three dimensional object can be removed from the object generator. Moreover, to complete the generation of each layer of the three dimensional object, typically several knotting operations must be performed. The "first knot" however, is a special knot that requires modifications to the standard knotting operation of the object generator. But before explaining the process of creating the first knot, the standard operation utilized by the invention to generate a standard knot is discussed.

In order to generate a standard knot on an existing stitch on a needle, the following steps are taken. First lift hook control mechanism 148 lowers lift hooks 159 and 161 at the same time to one side of the needle where the standard knot operation is to take place. The lift hooks are lowered to the side of the needle so that they can grab the head of a stitch on that needle. Lift hook control mechanism 148 then lifts up the lift hooks thus pulling up the yarn that comprised the stitch. The lift hooks are lifted to a level just above knot hook 163. The lift hooks are then turned one hundred and eighty degrees (180°) in the z-axis. The one hundred and eighty degree turn creates a slight twist in the yarn held by the two lift hooks. The two lift hooks (i.e. lift hooks 159 and 161) are then slightly separated (while the yarn hangs from the hooks of the two lift hooks) so that knot hook 163 can grab the yarn from between the two lift hooks. Knot hook 163, being attached to the top of bobbin/tensioning mechanism 146 is rotated three hundred and sixty degrees (360°) as the top of bobbin/tensioning mechanism 146 rotates. The direction of the 360° rotation of the knot hook is opposite to the direction of the 180° turn of the two lift hooks. Thus, when the 360° rotation of the knot hook is completed, a "slack" knot has been formed through wrapping the yarn around the lower part of the bobbin/tensioning mechanism 146. However, the slack knot must be passed down to the needle where the yarn was lifted from and the knot must also be tightened up.

In order to pass the yarn making up the slack knot down to the needle level, the yarn must first clear the bobbin/tensioning mechanism. This is accomplished by passing the yarn down from between the four sets of clearing wheels 247, 249, 251, and 253. Once the yarn clears the bobbin/tensioning mechanism by passing through the clearing wheels, lift hook control mechanism 148 releases the yarn from the two lift hooks. At this point, tension control 210 (housed inside bobbin/tensioning mechanism 146) pulls in the slack yarn from the "slack knot" thus causing the knot to be driven down to the needle level and tightened on the needle at the substantially the same time due to the pull from tension control 210. Thus a "standard" knot has been created.

Before a "first knot" can be created, yarn must by "laid under." Usually (for example when a new stitch is being created) yarn is provided to the knitting needle from above the needle. However, in some circumstance such as creation of a first knot, yarn is provided from underneath the knitting needle. For yarn to be provided from underneath the knitting needle, the yarn must first be "laid under" that needle. "Laying under" involves the following steps. The latch of the needle where yarn is to be laid under is closed so that the yarn can slip off of the needle without getting trapped in the needle's hook. Then, feed guide 190 lays yarn on top of the needle while the needle's latch is kept closed. Thereafter the needle control portion of a magnetic actuator 132 (or a magnetic actuator 142) pulls the needle back into the tuck state (while keeping the latch closed). Finally, the feed guide is lowered below the needle and the needle control portion of magnetic actuator 132 (or a magnetic actuator 142) returns the needle to its rest position (while the latch is still kept closed). The slopped potion of the sloped hooks 235 (or sloped hooks 245) assists in causing the yarn to slip under the needle as the needle reverts back to its rest position. Following the steps described above, yarn can be laid under any of the y-axis or x-axis needles.

In a first knot operation, unlike the standard knot operation described above, one end of the yarn is cut and in the absence of the first knot operation would remain loose and untied to the stitches making up the three dimensional object. Indeed, in the absence of the first knot operation, the cut and loose yarn would make any generated object unstable. To create a "first knot" on a particular needle the following steps are taken by the invention's object generator. Feed guide 190, which at this point is temporarily holding the cut and loose end of the yarn, is positioned on one side of the needle where the first knot is to be created. Holder 188 grabs and holds the cut and loose end of the yarn from feed guide. The feed guide lays the yarn under the needle while the yarn is cut and loose and is being held by the holder. The laying under operation is the same as that described above. Thus, while the cut and loose end of the yarn is being held by holder 188, the yarn is placed underneath the needle. Then a standard knotting operation is performed by using the two lift hooks to grab the yarn from between the holder and the needle. After the knotting operation is complete, the holder lets go of the yarn and it (the holder) is retracted back into its original rest position. Thus, a first knot has been created.

The first layer of the three dimensional object must be generated in a special way in order for the final object to have a stable structure. The reason for the special treatment of the first layer is that, unlike layers after the first layer, the needles do not have any existing stitches or loops on them. As explained above, the generation of new stitches depends on and presumes existence of "old" (i.e. existing) stitches or loops which form the basis for supporting new stitches. However, for the very first layer there are of course no existing stitches or loops on either the x-axis or the y-axis needles. Thus, the special procedure explained below must be followed.

On the very first needle of the first layer, a first knot must be created in the manner explained above. On the subsequent needles a loop is formed on each needle to form the first layer of the object. The loop on each needle is generated by essentially looping the yarn around the needle in the following manner. First the needle's latch 231 (or 241) is opened and feed guide 190 places yarn is placed in the open latch. Thereafter the needle control portion of a magnetic actuator 132 (or a magnetic actuator 142) pulls the needle into the tuck state (while keeping the latch open). Since the needle's latch is open the yarn is trapped by the needle's hook and is pulled by the needle. While the yarn is trapped and held by the needles hook, the feed guide is lowered below the needle and the feed guide travels to the opposite side of the needle. This action passes yarn from underneath the needle to the opposite side of the needle. Then the needle control portion of a magnetic actuator 132 (or a magnetic actuator 142) reverts the needle into the rest state (while keeping the latch open). This action releases the yarn from the hook. The feed guide is lifted up and takes yarn back to the side of the needle where the feed guide was originally lowered. This action of the feed guide completes one loop of yarn around the needle. The loop thus formed looks substantially like loop 92 shown in FIG. 9. The feed guide is then lowered and placed at the side of a new needle to form loop around the new needle. When all of the needles of the first layer have a loop around them the first layer is complete.

During generation of a three dimensional object, it may be necessary for the invention's object generator to transfer existing loops and stitches from one half of y-frame 130 to the other half of y-frame 130. Similarly, it may be necessary to transfer existing loops and stitches from one half of x-frame 140 to the other half of x-frame 140. The transfer of loops and stitches from one half of the y-frame to the other half of the y-frame (or from one half the x-frame to the other half of the x-frame) is called "frame transfer." The procedure for performing a frame transfer is explained with respect to the y-frame; however, a similar procedure applies to a frame transfer performed in the x-frame.

Initially, it is noted that during the entire frame transfer operation, all needle latches (on the x-frame and the y-frame) are kept in a closed position. To begin a frame transfer operation in the y-frame, the opposing two halves of the y-frame are brought together so that the needle tips of the opposing needles of each half are touching one another. In order to move the loops and stitches that exist on one half of the y-frame to the other half of the y-frame, the two halves of the y-frame move in the same direction and with the same speed so that the needle tips remain in a touching position during the entire frame transfer procedure. As the two halves of the y-frame move together, the x-frame needles block any movement of the loops and stitches present on the y-axis needles. This blocking action keeps the y-axis needles' stitches and loops stationary while the y-axis needles move through the stationary stitches and loops until the stitches and needles from one half of the y-frame are transferred to the other half the y-frame. Thus, a frame transfer operation in the y-frame is completed. As stated above, a similar procedure is followed to perform a frame transfer operation in the x-frame.

Although the invention's object generator can fabricate a three dimensional object using only y-frame 130 or only x-frame 140, it is sometimes desirable to stop the knitting action on the y-frame and initiate knitting in the x-frame. This of course requires stopping the knitting action on a y-axis needle and initiating the knitting action on an x-axis needle. Since knitting on y-axis needles results in generating a knitting course in the x-axis direction, and knitting on x-axis needles results in generating a knitting course in the y-axis direction, the switching from y-frame knitting to x-frame knitting is also referred to as switching the knitting axis from the x-axis to the y-axis.

In order to switch from y-frame knitting to x-frame knitting (i.e. to switch the knitting axis from the x-axis to the y-axis), the sinkers lying along the x-axis, i.e. high-y sinker rail 164 and low-y sinker rail 166 are fully retracted. The feed guide is then moved to the appropriate x-axis needle. Generally, this x-axis needle is one of the four needles that is adjacent to the most recent y-frame knitting course (i.e. the most recent knitting course along the x-axis). Finally, the sinkers lying along the y-axis, i.e. high-x sinker rail 168, and low-x sinker rail 170 are lowered to their "clear" state and the knitting action can begin in the x-frame, i.e. knitting can begin in the direction of the y-axis. A similar procedure is followed to switch from x-frame knitting to y-frame knitting (i.e. to stop knitting in the direction of the y-axis and initiate knitting in the direction of the x-axis).

Figure 12:
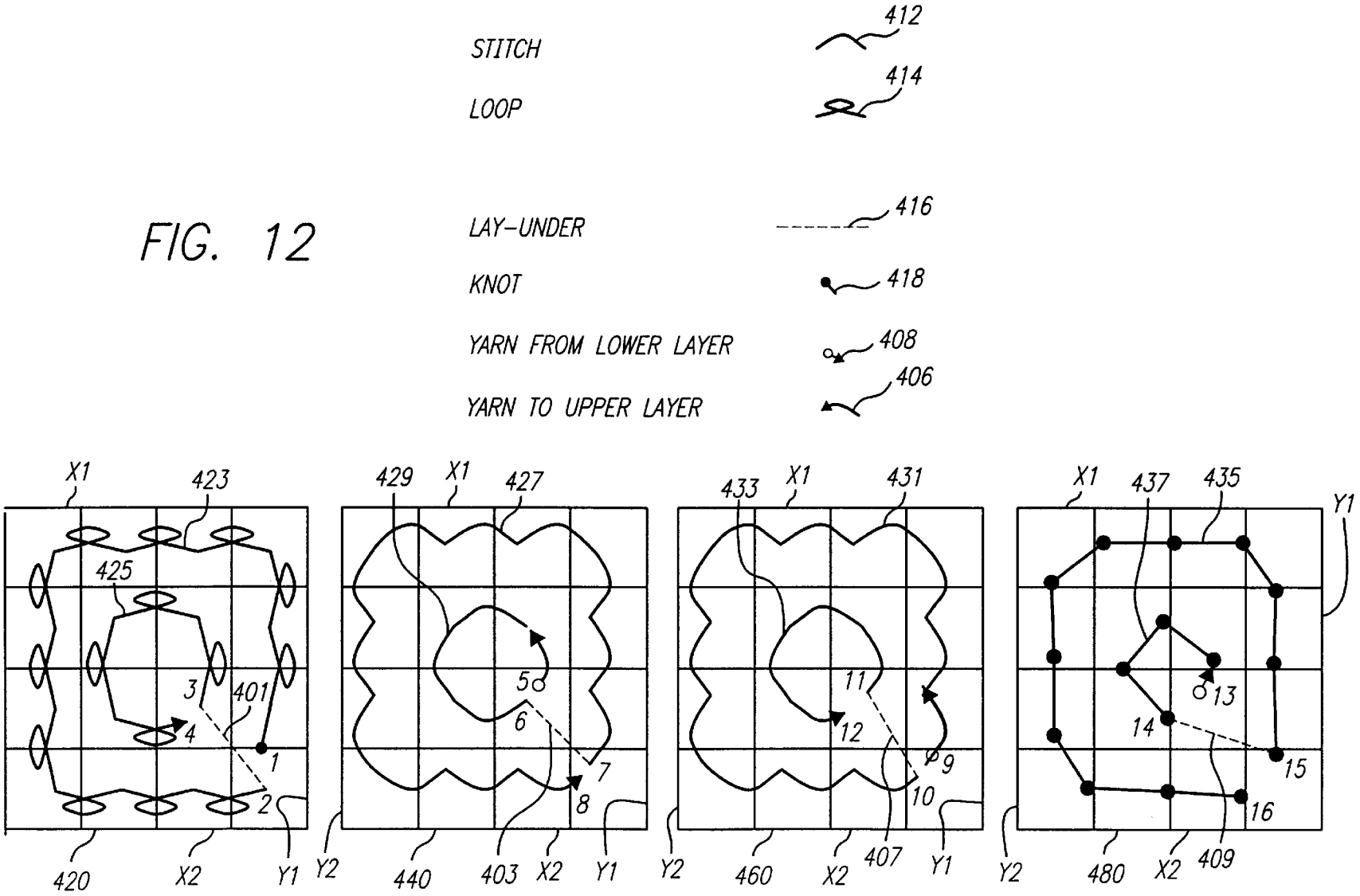
FIG. 12 illustrates the invention's layer by layer generation of a three dimensional object by way of symbolic diagrams.
Figure 13:
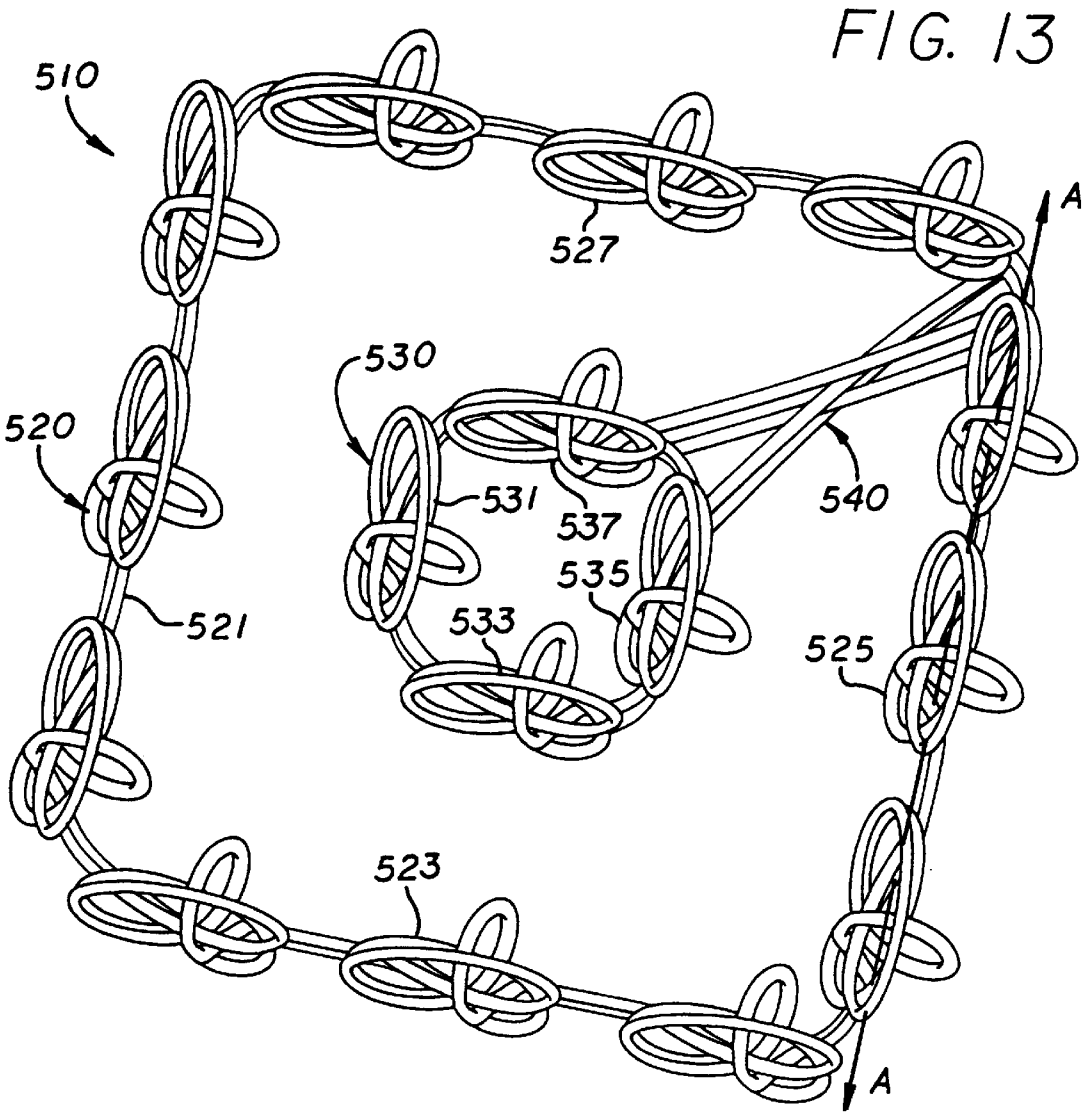
FIG. 13 is a top view of the three dimensional object generated by the present invention corresponding to the layer by layer generation shown in FIG. 12.
Figure 14:
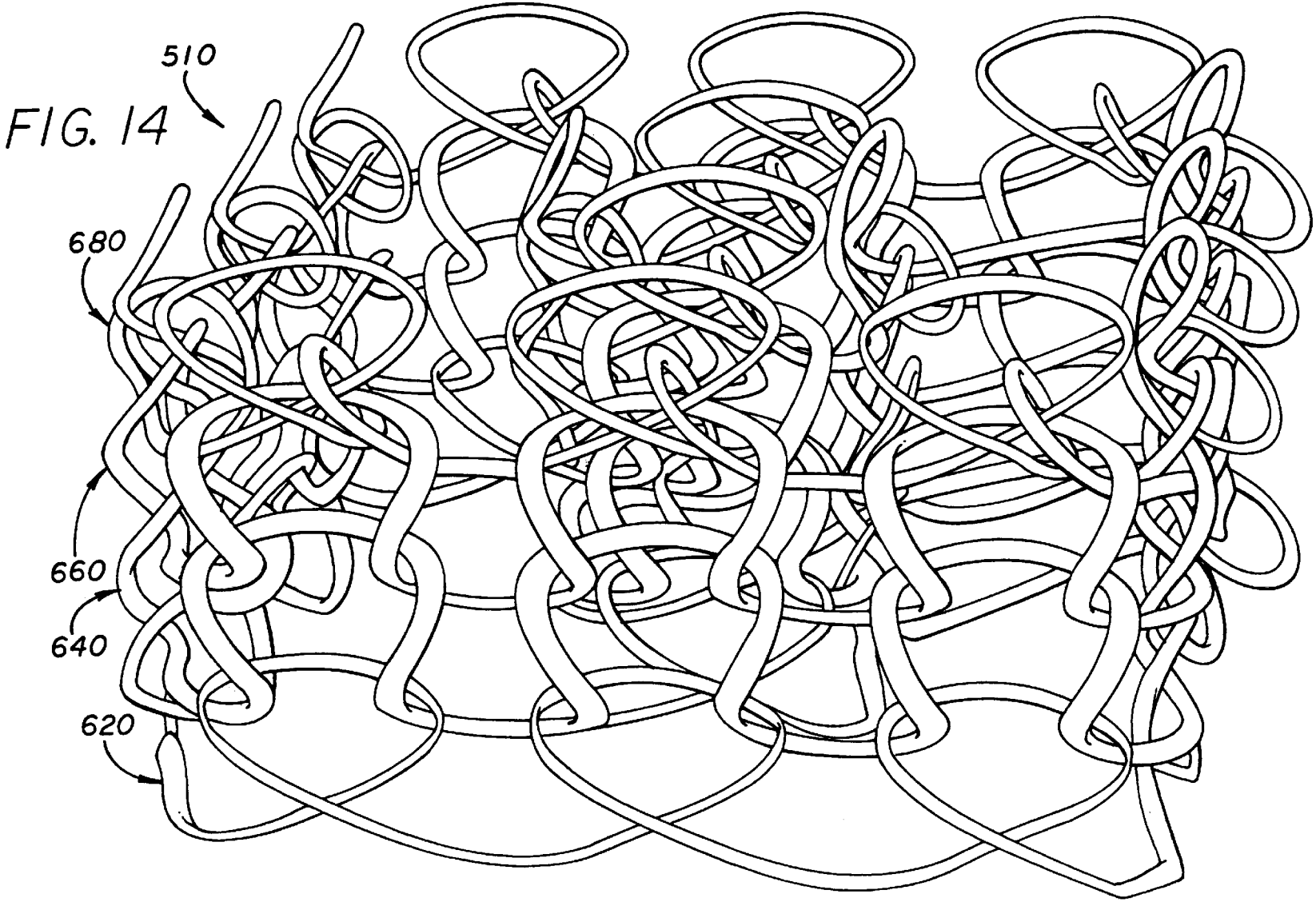
FIG. 14 is a side view of a three dimensional object generated by the present invention corresponding to the layer by layer generation shown in FIG. 12.

As discussed above, the invention's object generator can generate objects that are truly three dimensional. Moreover, the three dimensional objects can be quite arbitrary. The discussion below and FIGS. 12 through 14 illustrate an example of an arbitrary three dimensional object that can be generated by the invention's object generator. Referring to FIG. 12, the nomenclature and the operational concepts used in the present invention and discussed above are shown by way of the following symbols in order to explain the generation of the particular arbitrary three dimensional object of FIGS. 12 through 14. Symbol 412 represents a stitch the same as stitch 82 discussed in relation to FIG. 8. Symbol 414 represents a loop the same as loop 92 discussed in relation to FIG. 9. Symbol 416 represents performance and completion of a "laying under" operation that was discussed above. Symbol 418 represents performance and completion of a knotting operation as discussed above. Symbol 418 represents either a standard knot or a first knot depending on which knot is needed during the generation of the three dimensional object. Symbol 408 represents yarn having arrived to an upper layer from a lower layer of the object being generated. Symbol 406 represents yarn leaving a lower layer to go to an upper layer of the object being generated.

The particular three dimensional object whose generation is discussed below in relation to FIGS. 12 through 14 is object 510 shown in FIG. 13. As shown in FIG. 13, object 510 has an outer structure 520 with four walls 521, 523, 525, and 527. Outer structure 520 is attached by bridge 540 to an inner structure 530 having four walls 531, 533, 535, and 537. Returning back to FIG. 12, diagram 420 shows the operational steps taken by the invention's object generator in order to complete generation of the first layer's outer structure 423 and the first layer's inner structure 425 of the three dimensional object 510 (shown in FIG. 13).

The invention's object generator begins at point "1" where a first knot is generated in the manner described above. Since at this point there are no existing loops or stitches on any of the needles, a number of loops are formed around the object generator's needles so as to complete the first layer's outer structure 423 which ends at point "2". It is noted that the path from point "1" to point "2" requires generating loops first along the y-axis which is designated as side "y1" in diagram 420. Knitting along the y-axis means of course means using the x-frame needles. The knitting frame is then switched over to the y-frame in order to initiate knitting along the x-axis. The knitting along the x-axis is designated as side "x1" in diagram 420. Continuing on the path from point "1" to point "2", the knitting frames are once again switched from the y-frame to the x-frame so that knitting can occur along the y-axis shown as side "y2" in diagram 420. The knitting frames are again switched from the x-frame to the y-frame so that knitting of the first layer's outer structure 423 can be completed along the x-axis shown as side "x2" in diagram 420.

At point "2", yarn is "laid under" in the manner described earlier in this application and the first layer bridge 401 is formed between the first layer's outer structure 423 and the first layer's inner structure 425. The knitting of the loops for the first layer's inner structure 425 begins at point "3". A number of loops are formed around the object generator's needles so as to complete the first layer's inner structure 425 which ends at point "4". At point "4", the object generator has completed the first layer of an object with four outer walls connected to four inner walls via a bridge. It is noted that the path from point "3" to point "4" requires generating loops first along the y-axis which is designated as side "y1" in diagram 420. Knitting along the y-axis means of course means using the x-frame needles. The knitting frame is then switched over to the y-frame in order to initiate knitting along the x-axis. The knitting along the x-axis is designated as side "x1" in diagram 420. Continuing on the path from point "3" to point "4", the knitting frames are once again switched from the y-frame to the x-frame so that knitting can occur along the y-axis shown as side "y2" in diagram 420. The knitting frames are again switched from the x-frame to the y-frame so that knitting of the first layer's inner structure 425 can be completed along the x-axis shown as side "x2" in diagram 420. As shown in diagram 420, upon completion of the generation of the first layer's inner structure 425 at point "4", the yarn is passed onto the upper layer (i.e. the second layer) of the object being generated.

Referring to diagram 440, at point "5", the second layer's inner structure 429 receives yarn from the first layer's inner structure 425. Since at this point there are already existing loops from the first layer of the object, stitches (as opposed to loops) are formed around the object generator's needles so as to complete the second layer's inner structure 429 which ends at point "6". It is noted that the path from point "5" to point "6" requires generating stitches first along the y-axis (side "y1" in diagram 440), then along the x-axis (side "x1" in diagram 440) and thereafter along the y-axis (side "y2" in diagram 440), and finally along the x-axis (side "x2" in diagram 440) as was explained with respect to the generation of the first layer in relation to diagram 420.

At point "6", yarn is "laid under" in the manner described earlier in this application and the second layer bridge 403 is formed between the second layer's inner structure 429 and the second layer's outer structure 427. The knitting of the stitches for the second layer's outer structure 427 begins at point "7". A number of stitches are formed around the object generator's needles so as to complete the second layer's outer structure 427 which ends at point "8". At point "8", the object generator has completed the second layer of an object with four outer walls connected to four inner walls via a bridge. It is noted that generation of the path between point "7" and point "8" requires generating stitches first along the y-axis (side "y1" in diagram 440), then along the x-axis (side "x1" in diagram 440) and thereafter along the y-axis (side "y2" in diagram 440), and finally along the x-axis (side "x2" in diagram 440) as was explained with respect to the generation of the first layer in relation to diagram 420. As shown in diagram 440, upon completion of the generation of the second layer's outer structure 427 at point "8", the yarn is passed onto the upper layer (i.e. the third layer) of the object being generated.

Referring to diagram 460, at point "9", the third layer's outer structure 431 receives yarn from the second layer's outer structure 427. Since at this point there are already existing stitches from the second layer of the object, stitches (as opposed to loops) are formed around the object generator's needles so as to complete the third layer's outer structure 431 which ends at point "10". It is noted that the path from point "9" to point "10" requires generating stitches first along the y-axis (side "y1" in diagram 460), then along the x-axis (side "x1" in diagram 460) and thereafter along the y-axis (side "y2" in diagram 460), and finally along the x-axis (side "x2" in diagram 460) as was explained with respect to the generation of the first layer in relation to diagram 420.

At point "10", yarn is "laid under" in the manner described earlier in this application and the third layer bridge 407 is formed between the third layer's outer structure 431 and the third layer's inner structure 433. The knitting of the stitches for the third layer's inner structure 433 begins at point "11". A number of stitches are formed around the object generator's needles so as to complete the third layer's inner structure 433 which ends at point "12". At point "12", the object generator has completed the third layer of an object with four outer walls connected to four inner walls via a bridge. It is noted that generation of the path between point "11" and point "12" requires generating stitches first along the y-axis (side "y1" in diagram 460), then along the x-axis (side "x1" in diagram 460) and thereafter along the y-axis (side "y2" in diagram 460), and finally along the x-axis (side "x2" in diagram 460) as was explained with respect to the generation of the first layer in relation to diagram 420. As shown in diagram 460, upon completion of the generation of the third layer's inner structure 433 at point "12", the yarn is passed onto the upper layer (i.e. the fourth layer) of the object being generated.

Referring to diagram 480, at point "13", the fourth layer's inner structure 437 receives yarn from the third layer's inner structure 433. In the present example, only four layers are required to complete object 510 (FIG. 13). Accordingly, the fourth layer is the final layer of the object. The last layer must consist of (standard) knots only in order for the generated three dimensional object to have a stable structure. The procedure to generate standard knots (as opposed to first knots) was explained earlier in this application. Thus, at point "13" the object generator begins to knit knots around the object generator's needles so as to complete the fourth layer's inner structure 437 which ends at point "14". It is noted that the path from point "13" to point "14" requires generating standard knots first along the y-axis (side "y1" in diagram 480), then along the x-axis (side "x1" in diagram 480) and thereafter along the y-axis (side "y2" in diagram 480), and finally along the x-axis (side "x2" in diagram 480) as was explained with respect to the generation of the first layer in relation to diagram 420.

At point "14", yarn is "laid under" in the manner described earlier in this application and the third layer bridge 409 is formed between the fourth layer's inner structure 437 and the fourth layer's outer structure 435. The knitting of the standard knots for the fourth layer's outer structure 435 begins at point "15". A number of standard knots are formed around the object generator's needles so as to complete the fourth layer's outer structure 435 which ends at point "16". At point "16", the object generator has completed the fourth and final layer of an object with four outer walls connected to four inner walls via a bridge. It is noted that generation of the path between point "15" and point "16" requires generating standard knots first along the y-axis (side "y1" in diagram 480), then along the x-axis (side "x1" in diagram 480) and thereafter along the y-axis (side "y2" in diagram 480), and finally along the x-axis (side "x2" in diagram 480) as was explained with respect to the generation of the first layer in relation to diagram 420. As shown in diagram 480, upon completion of the generation of the fourth layer's outer structure 435 at point "16", a final knot is created at that point. Thus, a three dimensional object having an outer structure with four walls connected via a bridge to an inner structure with four walls has been generated.

Following the procedure explained in relation to diagrams 420, 440, 460, and 480 in FIG. 12, the final object 510 shown in FIG. 13 is generated. Object 510 has an outer structure 520 that is connected to an inner structure 530 through a bridge 540. As shown in FIG. 13, outer structure 520 has four walls 521, 523, 525, and 527 while inner structure 530 has four walls 531, 533, 535, and 537. A cross-section of object 510 taken along line AA is shown in FIG. 14 which illustrates the four layers of the three dimensional object 510 of FIG. 13.

Referring to FIG. 14, the four layers of object 510, i.e. layers 620, 640, 660, and 680 are illustrated. First layer 620 corresponds to diagram 420 in FIG. 12 which illustrated the procedure to make first layer outer structure 423 and first layer inner structure 425. Second layer 640 corresponds to diagram 440 in FIG. 12 which illustrated the procedure to make second layer inner structure 429 and second layer outer structure 427. Third layer 660 corresponds to diagram 460 in FIG. 12 which illustrated the procedure to make third layer outer structure 431 and third layer inner structure 433. And finally, fourth layer 680 corresponds to diagram 480 in FIG. 12 which illustrated the procedure to make fourth layer inner structure 437 and fourth layer outer structure 435.

As shown in FIG. 14, layer 620 consists entirely of loops. These loops were shown symbolically in diagram 420 of FIG. 12. Moreover, a more realistic representation of one of the loops in layer 620 was shown as loop 92 in FIG. 9 and the procedure to form such a loop was discussed in relation to FIG. 9 and also in other parts of the present application. Layers 640 and 660 consist entirely of stitches. These stitches were shown symbolically in diagrams 440 and 460 of FIG. 12. Moreover, a more realistic representation of one of the stitches in layers 640 and 660 was shown as stitch 82 in FIG. 8 and the procedure to form such a stitch was discussed in relation to FIG. 8 and also in other parts of the present application. Layer 680 consists entirely of (standard) knots. These knots were shown symbolically in diagram 480 of FIG. 12. Moreover, the procedure to form a standard knot was discussed earlier in the present application.

Since FIG. 14 is an illustration of a cross-section taken along line AA in FIG. 13, only the layers belonging to outer structure 520 can be seen in FIG. 14 while the layers belonging to inner structure 530 or bridge 540 are obscured from view. As illustrated in FIG. 14, layer 680 is the top layer while layer 620 is the bottom layer in object 510. It is seen from FIG. 14, that object 510 has a considerable height (i.e. the distance from top layer 680 to bottom layer 620) relative to the width or length of object 510 shown in FIG. 14. Thus, object 510 generated by the object generator of the present invention is indeed a truly three dimensional object.

It is noted that as stated above, the invention can generate arbitrary three dimensional objects of any shape. For example, the invention's object generator can generate the two outer structure 520 and inner structure 530 shown in FIG. 13 without bridge 540. In that case the object generator has, in reality, generated two separate objects that are not connected to each other. However, this illustrates that the invention's object generator is quite flexible and can in fact generate more than one object concurrently.

Another point to note is that the process of generating an object having an overall configuration as object 510 can be accomplished only on the y-frame or only on the x-frame. In other words, a four layer object having an outer structure with four walls connected via a bridge to an inner structure with four walls can be generated by using either the y-frame or the x-frame and without using both the y-frame and the x-frame. However, the procedure to make an object such as object 510 using only the y-frame or the x-frame would be different from that described in diagrams 420, 440, 460, and 480 of FIG. 12. Moreover, the internal structure of the object, such as the orientation and density of the loops and stitches, would be different from the internal structure of object 510. Nevertheless, the overall configuration, i.e. an outer structure with four walls connected via a bridge to an inner structure with four walls, can be generated by using either the y-frame or the x-frame and without using both the y-frame and the x-frame.

During the generation of any object, for example object 510 discussed in relation to FIGS. 12 through 14, the invention's lowering mechanism 194 (shown in FIG. 4) is utilized. As explained earlier in this application, upper surface 198 of the lowering mechanism can move up and down (i.e. the upper surface moves along the z-axis) while lower surface 202 of the lowering mechanism is stationary (FIG. 4). Upper surface 198 of the lowering mechanism supports the first layer of an object being generated. For example, first layer 620 of object 510 (which first layer is itself comprised of the first layer of an outer structure, the first layer of an inner structure, and the first layer of a bridge) is supported by the upper surface of the lowering mechanism. First layer 620 rests on top of the lowering mechanism while the remaining layers of object 510 are being generated. The upper surface of the lowering mechanism is lowered as the remaining three layers of object 510 are being generated. The purpose of the lowering mechanism is to absorb and reduce downward pressure on the knitting needles and the various layers of the object as the object is being generated. In the example of object 510 shown in FIG. 14, during the generation of layer 680, the knitting needles and layer 680 would not have to bear the weight of layers 660, 640, and 620 since the weight of these layers would be supported by the lowering mechanism.

As was stated earlier in the present application, the invention's object generator utilizes a printer jet 208 (see, for example, FIG. 6) to color the yarn as the yarn is being provided to the feed box. The printer jet adds a color coating to the yarn being fed to the feed box under computer control. For example, each layer 620, 640, 660, and 680 of object 510 shown in FIG. 14 may have a color different from that of the other layers. Moreover, each loop, stitch, and knot in any given layer may also have a color different from that of other loops, stitches, and knots. Since the control software running the object generator's computer "knows" where each portion of the yarn will end up in the final object, each portion of the yarn is color coated with the intended color (also referred to as the "target color" in this application) as the yarn is fed to the feed box.

As stated earlier in the present application, all operations of the object generator are controlled by a computer having a three dimensional image of the desired object and providing layer by layer data to the object generator through a 3D modeling language such as VRML, STL, or IGES. The computer controlling the invention's object generator is also equipped with a customized control software that translates the layer by layer data obtained from VRML, STL, or IGES to specific commands for performing specific operations of the object generator.

A "Goto (F,N, Se, Si, C)" command moves the feed box to a specific location on the grid formed by the x-frame and the y-frame to perform a desired knitting action. The variable "F" in the command string corresponds to the desired frame. Thus, "F" can accept only two values. One of the values would designate the x-frame and the other value would designate the y-frame as the selected frame. The variable "N" in the command string corresponds to the desired needle number in the selected frame. For example, if in the particular embodiment of the object generator there are two hundred x-axis needles and two hundred y-axis needles, the "N" variable can accept an integer value between one and two hundred. Thus, the combination of the "F" and "N" variables designates a unique needle in the y-frame or a unique needle in the x-frame.

The "Se" variable corresponds to which "segment" of a selected needle the feed box is directed to. A "segment" as used here is defined as a section of a y-axis needle that is between two adjacent x-axis needles, or conversely, a section of an x-axis needle that lies between two adjacent y-axis needles. Thus, each y-axis needle lying in the grid formed by the x-frame and the y-frame is divided into a number of equal segments. Likewise, each x-axis needle lying in the grid formed by the y-frame and the x-frame is divided into a number of equal segments. For example, each of the y-axis needles and x-axis needles can be divided into two hundred segments. Thus, the variable "Se" can accept an integer value between one and two hundred. Therefore, the combination of the "F," "N," and "Se" variables specifies a single needle and a specific segment of that needle.

The variable "Si" corresponds to which of the two sides of a needle the feed box should be placed. Even though a specific segment of a specific needle has been pinpointed, the various knitting operations, such as a "laying under" operation can begin from either of the two sides of the needle. With respect to the y-axis needles, one of the sides would be a "high-x" side and the other side would be a "low-x" side where the high-x side is slightly further away from the origin of the x-axis as compared to the low-x side. With respect to the x-axis needles, one of the sides would be a "high-y" side and the other side would be a "low-y" side where the high-y side is slightly further away from the origin of the y-axis as compared to the low-y side. Thus the "Si" variable can accept only two values.

Finally, the "C" variable corresponds to the particular color that the yarn is to have at a particular knitting location. For example, if the printer jet can generate 256 different colors for coating the yarn, the "C" variable can have an integer value between one and 256. The customized software controlling the invention's object generator performs calculations to determine which exact portion of the yarn must be colored so that the portion of the yarn used in the final object will have the intended color.

The customized control software controlling the invention's object generator also includes commands such as "St," "Lp," "Kt," or "Fkt." These commands direct the invention's object generator to create, respectively, a stitch, a loop, a knot, or a first-knot in the manner described earlier in this application and at a location designated by the Goto command. Other commands such as "Lu" or "Ct" direct the object generator to perform, respectively, a laying-under or a cut operation (for example, cut yarn after a knotting operation) at a location designated by the Goto command. Using the Goto command and other commands discussed above, the object generator is able to generate any arbitrary three dimensional object such as object 510 discussed in relation to FIGS. 12 through 14.

The customized control software operating the invention's object generator directs critical operations other than the ones discussed above. For example, the customized control software is utilized to determine a strategy to generate a given object such that the total time required to generate the object is minimized. In general, the total time to generate a given three dimensional object is determined by the following formula.

$$T_{total}=T_{stitch}+T_{knot}+T_{lay\text{-}under}+T_{loop}+T_{frame\text{-}switch}$$

According to the above formula the grand total time to generate a three dimensional object is the sum of the total time spent in stitch generation operations, added to the total time spent in knot generation operations (including both standard knots and first knots), added to the total time spent in laying-under operations, loop generation operations, and frame switching operations. In the preferred embodiment of the invention described in the present application, the amount of time required for various individual operations is ranked according to the formula below.

$$T_{knot}>>T_{frame\text{-}switch}>>T_{loop}>T_{lay\text{-}under}>T_{stitch}$$

According to the above formula, the time required to generate a knot (either a standard knot or a first knot) is much greater than the time required to switch knitting frames which is in turn much greater than the time required to generate a loop. The time required to generate a loop is in turn greater than the time required to perform a laying-under operation. Finally, the time required to generate a stitch is less than the time required to perform a laying-under operation.

As an example of how the custom control software minimizes the time required to generate a given three dimensional object, it is apparent from the above two formulae that one goal of the custom control software is to minimize the number of knotting operations. One way to minimize the number of knotting operations is to rotate the three dimensional image of the object to be generated so as to reduce the number of total knots required in generation of the physical object. For example, 90 degree rotations may be performed in order to compare the total number of required knotting operations.

Figure 15B:
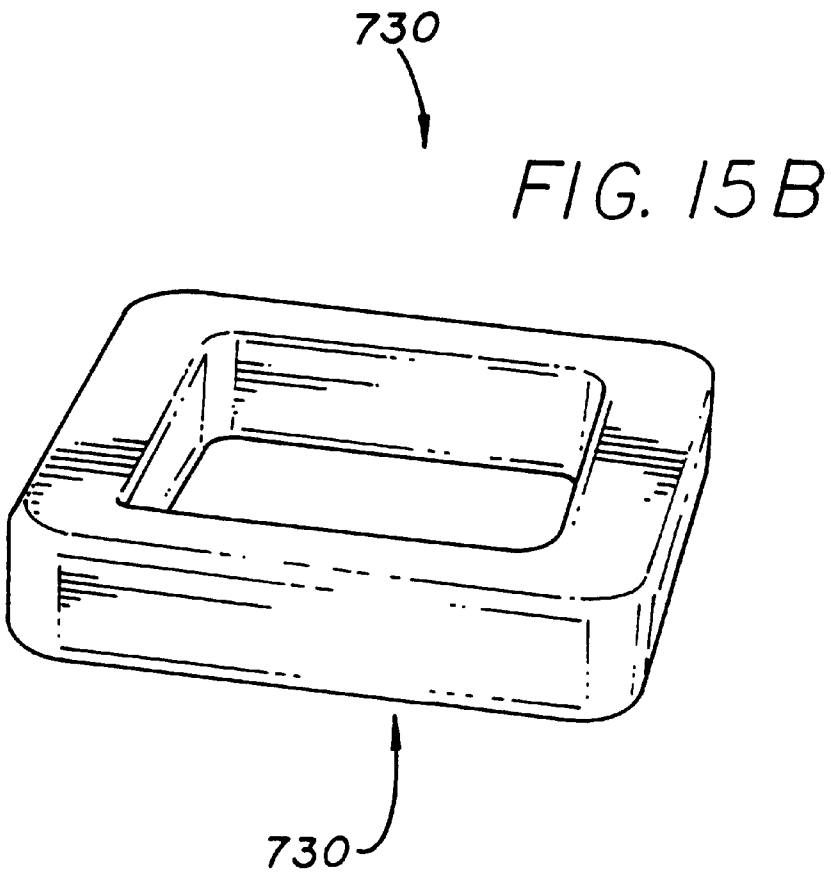
FIG. 15B illustrates another orientation of a three dimensional image from which a physical three dimensional object (the same physical three dimensional object subject of FIG. 15A) is to be generated.
Figure 15A:
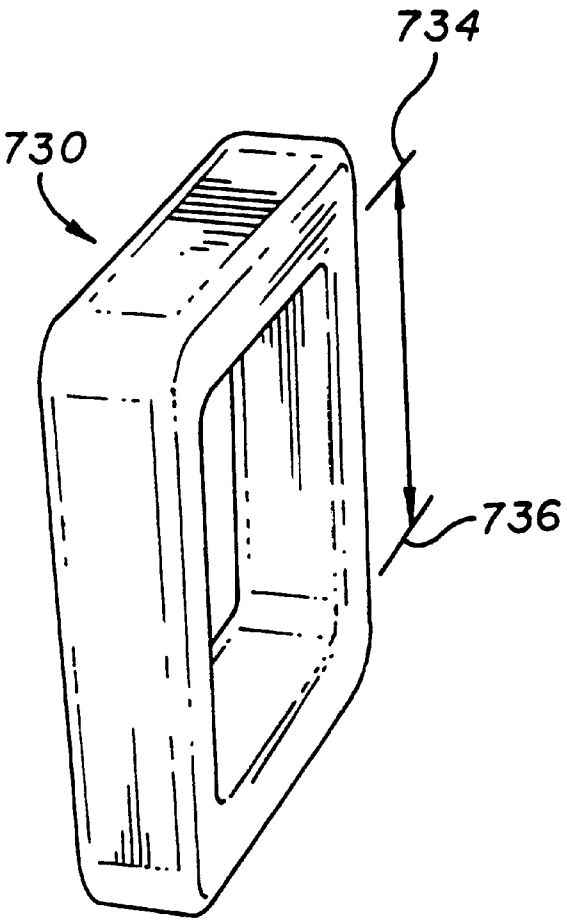
FIG. 15A illustrates one orientation of a three dimensional image from which a physical three dimensional object is to be generated.

By way of example, FIGS. 15A and 15B show the same three dimensional image 730, but at two different orientations. The three dimensional object generated from the layer by layer data fed from the three dimensional image shown in FIG. 15A would have a greater number of knotting operations compared to the number of knotting operations used to generate the same object from the three dimensional image shown in FIG. 15B. The reason for this difference in the number of knotting operations is explained by reference to FIGS. 15A, 15B and FIGS. 16A and 16B.

Figure 16B:
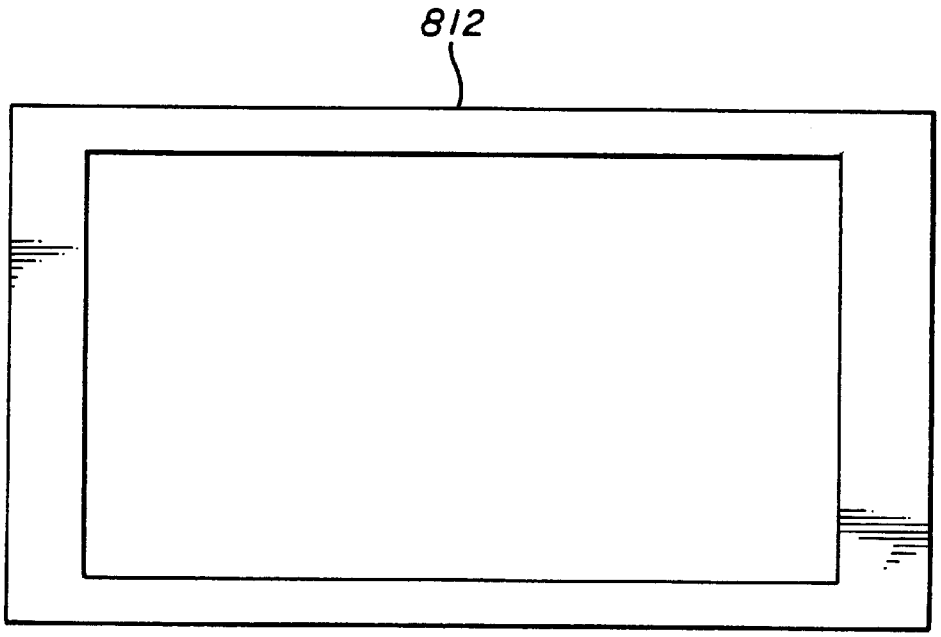
FIG. 16B is an illustration of a shape of a two dimensional layer corresponding to the three dimensional image shown in FIG. 15B.
Figure 16A:
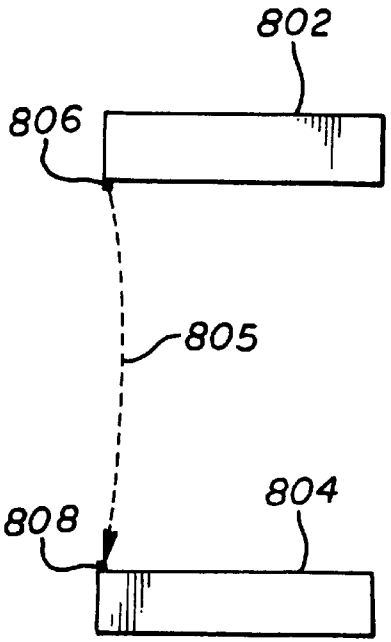
FIG. 16A is an illustration of a shape of a two dimensional layer corresponding to a portion of the three dimensional image shown in FIG. 15A.

Referring to FIG. 166A, the three dimensional image corresponding to a vertical accumulation of the two dimensional layer data shown in FIG. 16A is a three dimensional object corresponding to the image confined between points 734 and 736 of FIG. 15A. As seen in FIG. 16A, the layer data consist of two entirely separate rectangles. The vertical accumulation of these two rectangles results in the three dimensional image between points 734 and 736 in FIG. 15A.

Referring to FIG. 16B, the three dimensional image corresponding to a vertical accumulation of the two dimensional layer data shown in FIG. 16B is a three dimensional object corresponding to the image shown in FIG. 15B. As seen in FIG. 16B, the layer data consist of the area confined between two concentric rectangles. The vertical accumulation of the two dimensional layer data shown in FIG. 16B results in the three dimensional image in FIG. 15B.

The generation of the same object, one from the orientation of the three dimensional image data shown in FIG. 15A and another from a different orientation of the three dimensional image data shown in FIG. 15B would consume very different amounts of time. The reason is that the generation of the two dimensional layers shown in FIG. 16A (corresponding to the orientation of the three dimensional image data shown in FIG. 15A) requires a greater number of knotting operations than the generation of the two dimensional layers shown in FIG. 16B (corresponding to the orientation of the three dimensional image data shown in FIG. 15B). FIG. 16A illustrates that once a first rectangle 802 is knitted, a knot 806 must be made to complete rectangle 802 (and the yarn must be cut following the making of the knot) in order to permit the feed guide and feed box to move to a second rectangle 804 to begin the knitting process there. However, to begin the knitting process at rectangle 804 a first knot 808 must be knitted to form a starting point. Arrow 805 indicates the movement of the knitting location from knot 806 in rectangle 802 to first knot 808 in rectangle 804. It is noted that to start knitting rectangle 802 no first knot was needed since yarn was fed from a lower layer, i.e. rectangle 802 is a continuation of the knitted layer directly below rectangle 802. Also, it is noted that to complete knitting rectangle 804 no knot is needed since the yarn is fed to the upper layer. In other words, the layer directly above rectangle 804 is a continuation of the rectangle 804. Nevertheless, for each two dimensional layer shown in FIG. 16A two knots 806 and 808 are required for the reason stated above.

In contrast, each layer 812 shown in FIG. 16B is self sustained and does not require any knots. Each layer 812 in FIG. 16B is a continuation of a layer directly below layer 812. Moreover, each layer 812 is continued by a layer directly above layer 812. Accordingly, no knots are required to make layer 812 a stable structure. Since the number of knots required to make each layer of the three dimensional orientation of the image data shown in FIG. 15A is much greater than the number of knots required to make each layer of the three dimensional orientation of the image data shown in FIG. 15B, it follows that the final physical object (which is the same for both FIGS. 15A and 15B) can be made with a lot fewer knots using the orientation of the image data shown in FIG. 15B as compared to the orientation of the image data shown in FIG. 15A. The reduction in the number of knots results in a shorter time to generate the object. Thus, after rotating the three dimensional image data to achieve the orientations shown in FIGS. 15A and 15B, the custom control software operating the invention's object generator would arrive at the conclusion that it is preferable to choose the orientation of image data shown in FIG. 15B in order to reduce the time required to generate the physical object.

V. Various Embodiments and Applications of the Present Invention

It is noted that the disclosure in the present application was thus far directed to a specific embodiment and a specific application of the invention's object generator. However, a number of other embodiments and applications of the present invention exist some of which are described in the present application. Thus, the scope of the present invention is determined by reference to the claims of the present application and not the specific embodiments and applications disclosed herein.

In one application of the specific embodiment of the invention's object generator described above, the knitting paths of the yarn are manipulated in order to modify the behavior of the resulting structure. For example, under direction of the custom control software, every other needle in the knitting path can be skipped. This creates a more sparse and elastic structure. In another application of the specific embodiment of the invention described above, the knitted three dimensional object has knitted therein random wires. Such wires could be electrical wires, heating wires, senors, or optical fibers.

In yet another application of the specific embodiment of the invention described above, the three dimensional objects produced by the invention's object generator are hardened through various post-processing operations. For instance, depending on the material used for the yarn, generated objects can be subsequently heated to make them more rigid or water-tight. The beating process can also result in melting some types of yarn, such as metallic or plastic yarns, and thus result in new shapes and physical properties of the generated object. Moreover, generated objects can be immersed in various fluid material that react with the particular yarn material used in the object in order to modify the object's physical properties such as the hardness and the tensile strength of the object.

In still another application of the specific embodiment of the invention described above, support structures that are not part of the eventually completed object are knitted to the object as the object is being generated. Upon completion of the object, the support structures are removed. The support structures are typically used to prevent the object from breaking during the object generation process.

As stated earlier in this application, the x-axis needles are also referred to as "dividers" in the present application. In fact, in one embodiment of the present invention, the x-axis needles are replaced with metallic bars that do not have hooks or latches (i.e. the bars are simply bars and do not act as knitting needles). In that embodiment of the invention, the metallic bars replacing the x-axis needles act to simply divide the y-axis needles into various segments and to keep stitches and loops on a given y-axis needle apart from other stitches and loops on the same y-axis needle. The dividers are also used to assist in various operations such as the frame transfer operation described earlier in the present application.

Another embodiment of the present invention utilizes more than one "object generator head." It is recalled from the description of the specific embodiment given above that the assembly of bobbin/tensioning mechanism 146, lift hook control mechanism 148, high x-rail head 149, low x-rail head 151, lift hooks 159 and 161, and feed box 160 is referred to in this application as the "object generator head" or simply as the "head." In one embodiment of the present invention, several heads are utilized on the same or separate rails. This would result in the use of several bobbins where each bobbin can have yarn of different material. For example, one of the bobbins can have yarn made of plastic, while the other can have yarn made of metal. The use multiple head would also increase the speed of generating objects since different parts of the objects can be generated concurrently. The different parts of the object can be connected together by a common portion of the object, which common portion is fabricated by yarn fed from all the heads of the object generator. In other words, the different heads of the object generator take turn in knitting a segment of the common portion of the object. In this manner the various portions of the object form a single object and remain interlocked through the common portion of the generated object.

In another embodiment of the present invention, the two halves of the y-frames can shift laterally with respect to one another. Thus, the stitches and loops residing in one half of the y-frame can shift in the direction of the x-axis. This lateral shifting of the y-frames provides additional flexibility in generating an arbitrary three dimensional object. It is appreciated that a similar lateral shift is possible for the two halves of the x-frame. In other words, one half of the x-frame can shift in the direction of the y-axis in relation to the other half of the x-frame.

Other examples of obvious variations of the present invention exist which are not described here in order not to obscure the fundamental features of the present invention. Manifestly, various additions and modifications of to the present invention can be made by persons of ordinary skill in the art without departing from the spirit and scope of the invention disclosed and claimed herein. Therefore, the scope of the present invention is defined by the claims of the present application and not the specific embodiments described herein.

Thus, a method and apparatus for fabrication of composite and arbitrary three dimensional objects has been described.

I claim:

1. A knitting machine for generating a three dimensional knitted object, said knitting machine comprising:

a top frame comprising a first row of needles opposite to a second row of needles;

a bottom frame comprising a first column of dividers opposite to a second column of dividers;

a head movable to a knitting location in a grid formed by said top and bottom frames, said head moving to said knitting location in response to a first plurality of commands from a computer;

said first and second rows of needles performing knitting action on a yarn in response to a second plurality of commands from said computer, said knitting action resulting in said three dimensional knitted object.

2. The knitting machine of claim 1 wherein said first plurality of commands comprise a Goto command, wherein said Goto command causes said head to be moved to said knitting location identified by a first plurality of coordinates.

3. The knitting machine of claim 2 wherein said first plurality of coordinates designate a needle.

4. The knitting machine of claim 2 wherein said first plurality of coordinates designate a segment.

5. The knitting machine of claim 2 wherein said first plurality of coordinates designate a frame.

6. The knitting machine of claim 3 wherein said first plurality of coordinates designate a side of said needle.

7. The knitting machine of claim 2 wherein said first plurality of coordinates designate a color.

8. The knitting machine of claim 1 wherein said second plurality of commands comprise a stitch command, wherein said stitch command causes a stitch to be formed at said knitting location.

9. The knitting machine of claim 1 wherein said second plurality of commands comprise a loop command, wherein said loop command causes a loop to be formed at said knitting location.

10. The knitting machine of claim 1 wherein said second plurality of commands comprise a knot command, wherein said knot command causes a knot to be formed at said knitting location.

11. The knitting machine of claim 1 wherein said second plurality of commands comprise a first-knot command, wherein said first-knot command causes a first knot to be formed at said knitting location.

12. The knitting machine of claim 1 wherein said second plurality of commands comprise a lay-under command, wherein said lay-under command causes yarn to be laid under at said knitting location.

13. The knitting machine of claim 1 wherein said head comprises a bobbin/tensioning mechanism, a lift hook control mechanism, a high x-rail head, a low x-rail head, a plurality of lift hooks, and a feed box.

14. The knitting machine of claim 1 wherein said first column of dividers comprises a first column of needles and said second column of dividers comprises a second column of needles.

15. The knitting machine of claim 14 wherein said first and second columns of needles performs knitting action on said yarn in response to said second plurality of commands from said computer, said knitting action resulting in said three dimensional knitted object.

16. A knitting machine for generating a three dimensional knitted object, said knitting machine comprising:

a top frame comprising a first column of needles opposite to a second column of needles;

a bottom frame comprising a first row of needles opposite to a second row of needles;

a head movable to a knitting location in a needle grid formed by said top and bottom frames, said head moving to said knitting location in response to a Goto command from a computer, said head dispensing yarn in response to commands from said computer;

said first column, second column, first row, and second row of needles performing knitting action on said yarn in response to commands from said computer, said knitting action resulting in said three dimensional knitted object.

17. The knitting machine of claim 16 wherein said computer commands said first column, second column, first row, and second row of needles to perform a stitch operation at said knitting location.

18. The knitting machine of claim 16 wherein said computer commands said first column, second column, first row, and second row of needles to perform a loop operation at said knitting location.

19. The knitting machine of claim 16 wherein said computer commands said first column, second column, first row, and second row of needles to perform a knot operation at said knitting location.

20. The knitting machine of claim 16 wherein said computer commands said first column, second column, first row, and second row of needles to perform a first knot operation at said knitting location.

21. The knitting machine of claim 16 wherein said computer commands said first column, second column, first row, and second row of needles to perform a lay-under operation at said knitting location.

22. A knitting machine for generating a three dimensional object, said knitting machine comprising:

a top frame comprising a first y-axis frame and a second y-axis frame, said first y-axis frame comprising a first plurality of y-axis needles and said second y-axis frame comprising a second plurality of y-axis needles, said first plurality of y-axis needles being opposed to said second plurality of y-axis needles;

a bottom frame comprising a first x-axis frame and a second x-axis frame, said first x-axis frame comprising a first plurality of x-axis needles and said second x-axis frame comprising a second plurality of x-axis needles, said first plurality of x-axis needles being opposed to said second plurality of x-axis needles;

a head movable to a knitting location in a grid formed by said top and bottom frames;

said top frame performing a top frame knitting action on a yarn dispensed from said head by engaging said yarn with said first plurality of y-axis needles and said second plurality of y-axis needles.

23. The knitting machine of claim 22 wherein said bottom frame performs a bottom frame knitting action on said yarn dispensed from said head by engaging said yarn with said first plurality of x-axis needles and said second plurality of x-axis needles.

24. The knitting machine of claim 22 wherein said top frame knitting action comprises making a first knot.

25. The knitting machine of claim 22 wherein said top frame knitting action comprises making a stitch.

26. The knitting machine of claim 22 wherein said top frame knitting action comprises making a loop.

27. The knitting machine of claim 22 wherein said top frame knitting action comprises making a standard knot.

28. The knitting machine of claim 23 wherein said bottom frame knitting action comprises making a first knot.

29. The knitting machine of claim 23 wherein said bottom frame knitting action comprises making a stitch.

30. The knitting machine of claim 23 wherein said bottom frame knitting action comprises making a loop.

31. The knitting machine of claim 23 wherein said bottom frame knitting action comprises making a standard knot.

32. The knitting machine of claim 22 wherein each of said first plurality of y-axis needles comprises a latch.

33. The knitting machine of claim 32 wherein said each of said first plurality of y-axis needles and said latch are operated by magnetic actuators.

34. The knitting machine of claim 22 wherein each of said second plurality of y-axis needles comprises a latch.

35. The knitting machine of claim 34 wherein said each of said second plurality of y-axis needles and said latch are operated by magnetic actuators.

36. The knitting machine of claim 23 wherein each of said first plurality of x-axis needles comprises a latch.

37. The knitting machine of claim 36 wherein said each of said first plurality of x-axis needles and said latch are operated by magnetic actuators.

38. The knitting machine of claim 23 wherein each of said second plurality of x-axis needles comprises a latch.

39. The knitting machine of claim 38 wherein said each of said second plurality of x-axis needles and said latch are operated by magnetic actuators.

40. The knitting machine of claim 22 wherein a stitch is transferred from said first y-axis frame to said second y-axis frame.

41. The knitting machine of claim 22 wherein a loop is transferred from said first y-axis frame to said second y-axis frame.

42. The knitting machine of claim 23 wherein a stitch is transferred from said first x-axis frame to said second x-axis frame.

43. The knitting machine of claim 23 wherein a loop is transferred from said first x-axis frame to said second x-axis frame.

44. The knitting machine of claim 22 wherein said first y-axis frame changes location while said first y-axis frame and said second y-axis frame remain in a single plane in said top frame.

45. The knitting machine of claim 22 wherein said second y-axis frame changes location while said first y-axis frame and said second y-axis frame remain in a single plane in said top frame.

46. The knitting machine of claim 23 wherein said first x-axis frame changes location while said first x-axis frame and said second x-axis frame remain in a single plane in said bottom frame.

47. The knitting machine of claim 23 wherein said second x-axis frame changes location while said first x-axis frame and said second x-axis frame remain in a single plane in said bottom frame.

48. The knitting machine of claim 22 wherein said top frame knitting action results in a three dimensional object.

49. The knitting machine of claim 48 wherein a lowering mechanism supports said three dimensional object when said top frame performs said top frame knitting action.

50. The knitting machine of claim 23 wherein said bottom frame knitting action results in a three dimensional object.

51. The knitting machine of claim 50 wherein a lowering mechanism supports said three dimensional object when said bottom frame performs said bottom frame knitting action.

52. The knitting machine of claim 22 wherein said first and second plurality of x-axis needles divide said first plurality of y-axis needles into a plurality of segments thereby causing a separation between stitches on said first plurality of y-axis needles.

53. The knitting machine of claim 22 wherein said first and second plurality of x-axis needles divide said second plurality of y-axis needles into a plurality of segments thereby causing a separation between stitches on said second plurality of y-axis needles.

54. The knitting machine of claim 22 wherein said first and second plurality of x-axis needles divide said first plurality of y-axis needles into a plurality of segments thereby causing a separation between loops on said first plurality of y-axis needles.

55. The knitting machine of claim 22 wherein said first and second plurality of x-axis needles divide said second plurality of y-axis needles into a plurality of segments thereby causing a separation between loops on said second plurality of y-axis needles.

56. The knitting machine of claim 22 wherein said yarn is composed of material selected from the group consisting of plastic, metal, wood, textile and paper.

57. The knitting machine of claim 22 wherein said yarn is selected from the group consisting of electrical wire, heating wire, sensing wire, and fiber optics wire.

58. A system for generating a three dimensional object, said system comprising:

a control computer having a control software for directing said system;

a top frame comprised of a plurality of y-axis needles and a bottom frame comprised of a plurality of x-axis needles;

a head movable to a plurality of knitting locations on said top and bottom frames;

a bobbin/tensioning mechanism for coloring and dispensing yarn;

wherein said control software directs said head to move to said plurality of knitting locations to perform a plurality of knitting actions on said yarn, and wherein said plurality of knitting actions generates said three dimensional object.

59. The system of claim 58 wherein said control software directs said bobbin/tensioning mechanism to color said yarn with a target color.

60. The system of claim 58 wherein said bobbin/tensioning mechanism houses a printer jet.

61. The system of claim 60 wherein said control software directs said printer jet to color said yarn with a target color.

62. The system of claim 58 wherein said control software determines said plurality of knitting locations so as to control a physical property of said three dimensional object.

63. The system of claim 62 wherein said physical property is an elasticity of said three dimensional object.

64. The system of claim 62 wherein said physical property is a density of said three dimensional object.

65. The system of claim 58 wherein said control software directs generation of a support object to bear a weight of said three dimensional object when said system performs said plurality of knitting actions.

66. A knitting machine for generating a three dimensional object, said knitting machine comprising:

a top frame comprising a first row of needles opposite to a second row of needles;

a bottom frame comprising a first column of dividers opposite to a second column of dividers;

a plurality of heads movable to a plurality of knitting locations in a grid formed by said top and bottom frames;

said first and second rows of needles performing a plurality of knitting actions on a yarn at each of said plurality of said knitting locations, said plurality of knitting actions generating said three dimensional object.

67. The knitting machine of claim 66 wherein said three dimensional object has a plurality of parts and each of said plurality of heads causes one of said plurality of parts to be generated.

68. The knitting machine of claim 67 wherein said plurality of parts of said three dimensional object are interlocked.

* * * * *